US008708055B2

(12) United States Patent
Liess et al.

(10) Patent No.: US 8,708,055 B2
(45) Date of Patent: Apr. 29, 2014

(54) APPARATUS AND METHODS FOR WEDGE LOCK PREVENTION

(71) Applicant: Weatherford/Lamb, Inc., Houston, TX (US)

(72) Inventors: Martin Liess, Seelze (DE); Bernd-Georg Pietras, Wedemark (DE)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 13/768,995

(22) Filed: Feb. 15, 2013

(65) Prior Publication Data

US 2013/0264837 A1 Oct. 10, 2013

Related U.S. Application Data

(63) Continuation of application No. 12/435,253, filed on May 4, 2009, now abandoned.

(60) Provisional application No. 61/126,223, filed on May 2, 2008, provisional application No. 61/126,301, filed on May 2, 2008, provisional application No. 61/050,121, filed on May 2, 2008.

(51) Int. Cl.
*E21B 23/00* (2006.01)
*E21B 19/22* (2006.01)

(52) U.S. Cl.
USPC .... 166/382; 166/77.1; 166/77.52; 166/77.53; 166/75.14

(58) Field of Classification Search
USPC ..... 166/385.2, 77.1, 77.52, 77.53, 85.1, 166/75.14; 294/86.15, 86.17; 414/908, 910
See application file for complete search history.

(56) References Cited

U.S. PATENT DOCUMENTS

| | | | |
|---|---|---|---|
| 1,155,926 | A | 10/1915 | Jack |
| 3,766,991 | A | 10/1973 | Brown |
| 3,964,552 | A | 6/1976 | Slator |
| 4,232,894 | A | 11/1980 | Taylor |
| 4,621,974 | A | 11/1986 | Krueger |
| 5,191,939 | A | 3/1993 | Stokley |
| 6,691,801 | B2 | 2/2004 | Juhasz et al. |
| 6,742,596 | B2 | 6/2004 | Haugen |

(Continued)

FOREIGN PATENT DOCUMENTS

| | | | |
|---|---|---|---|
| WO | 2007001793 | A2 | 1/2007 |
| WO | 2007070805 | A2 | 6/2007 |

OTHER PUBLICATIONS

International Search Report and Written Opinion for Application No. PCT/US2009/042753 dated Aug. 26, 2011.

(Continued)

*Primary Examiner* — Cathleen Hutchins
(74) *Attorney, Agent, or Firm* — Patterson & Sheridan, L.L.P.

(57) ABSTRACT

In one embodiment, a tubular handling apparatus is provided with a wedge lock release mechanism that creates a clearance to allow movement by the mandrel having mating wedge surfaces relative to the tubular to release the wedge slips. In another embodiment, a tubular handling apparatus for handling a tubular includes a mandrel; a carrier coupled to the mandrel; a gripping element for engaging the tubular; an engagement member coupled to the carrier for engaging an upper portion of the tubular; and an abutment device adapted to engage the engagement member, wherein a length of the abutment device is adjustable to allow movement of the engagement member.

20 Claims, 35 Drawing Sheets

(56) References Cited

U.S. PATENT DOCUMENTS

| | | | |
|---|---|---|---|
| 6,938,697 | B2 | 9/2005 | Haugen |
| 7,182,133 | B2 | 2/2007 | Webre et al. |
| 7,228,913 | B2 | 6/2007 | Folk et al. |
| 7,281,587 | B2 | 10/2007 | Haugen |
| 7,370,707 | B2 | 5/2008 | McDaniel et al. |
| 7,654,325 | B2 | 2/2010 | Giroux et al. |
| 7,984,757 | B1 | 7/2011 | Keast et al. |
| 8,100,187 | B2 | 1/2012 | Begnaud et al. |
| 8,365,834 | B2 | 2/2013 | Liess et al. |
| 2002/0043403 | A1 | 4/2002 | Juhasz et al. |
| 2002/0074132 | A1 | 6/2002 | Juhasz et al. |
| 2002/0170720 | A1 | 11/2002 | Haugen |
| 2003/0066654 | A1 | 4/2003 | Juhasz et al. |
| 2004/0069500 | A1 | 4/2004 | Haugen |
| 2004/0173358 | A1 | 9/2004 | Haugen |
| 2005/0000696 | A1 | 1/2005 | McDaniel et al. |
| 2005/0279507 | A1 | 12/2005 | Folk et al. |
| 2006/0005962 | A1 | 1/2006 | Juhasz et al. |
| 2006/0118293 | A1 | 6/2006 | Juhasz et al. |
| 2006/0124293 | A1 | 6/2006 | Juhasz et al. |
| 2006/0169461 | A1 | 8/2006 | Haugen |
| 2007/0131416 | A1 | 6/2007 | Odell et al. |
| 2007/0272417 | A1* | 11/2007 | Benson ..... 166/379 |
| 2008/0059073 | A1 | 3/2008 | Giroux et al. |
| 2008/0083540 | A1 | 4/2008 | Haugen |
| 2008/0110637 | A1 | 5/2008 | Snider et al. |
| 2008/0149326 | A1 | 6/2008 | Angelle et al. |
| 2008/0264648 | A1 | 10/2008 | Pietras et al. |
| 2009/0151934 | A1 | 6/2009 | Heidecke et al. |
| 2009/0274545 | A1 | 11/2009 | Liess et al. |
| 2010/0200215 | A1 | 8/2010 | Juhasz et al. |
| 2010/0314100 | A1 | 12/2010 | Tepavac et al. |
| 2011/0017474 | A1 | 1/2011 | Pietras et al. |
| 2011/0174483 | A1 | 7/2011 | Odell, II et al. |

OTHER PUBLICATIONS

Canadian Office Action for Application No. 2,722,543, dated May 18, 2012.

* cited by examiner

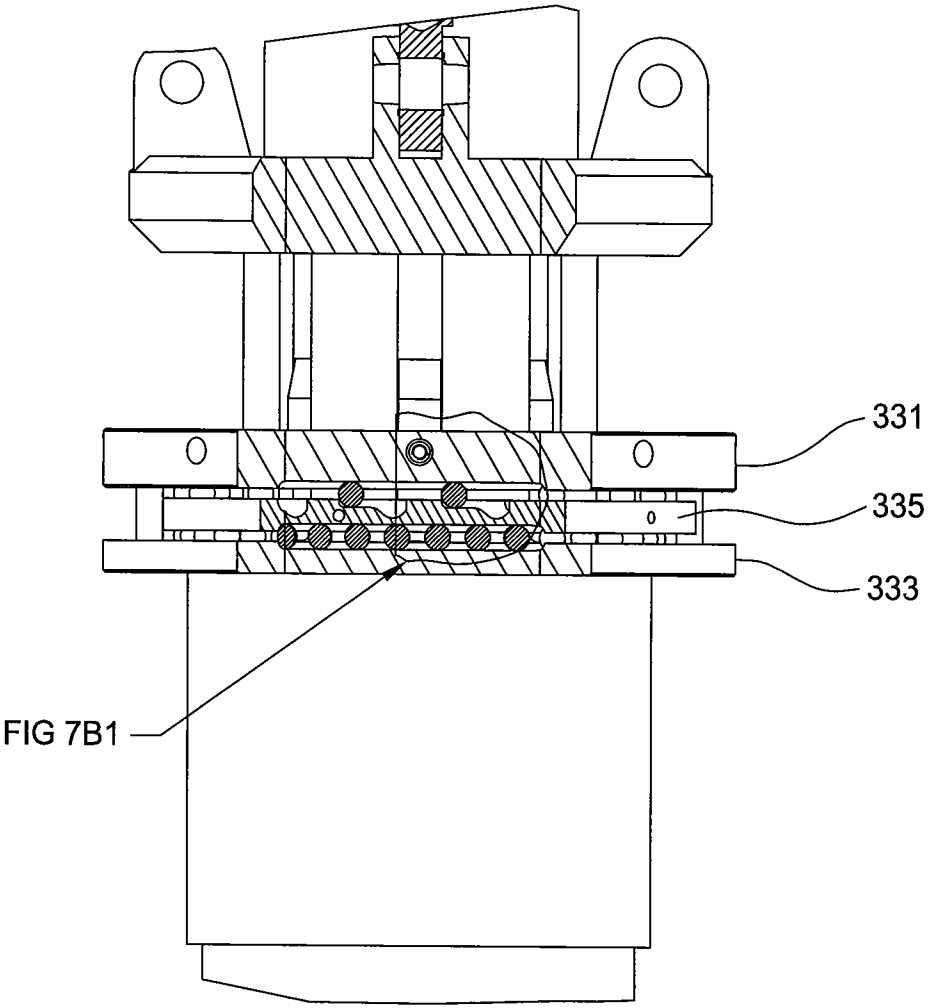
FIG. 7B
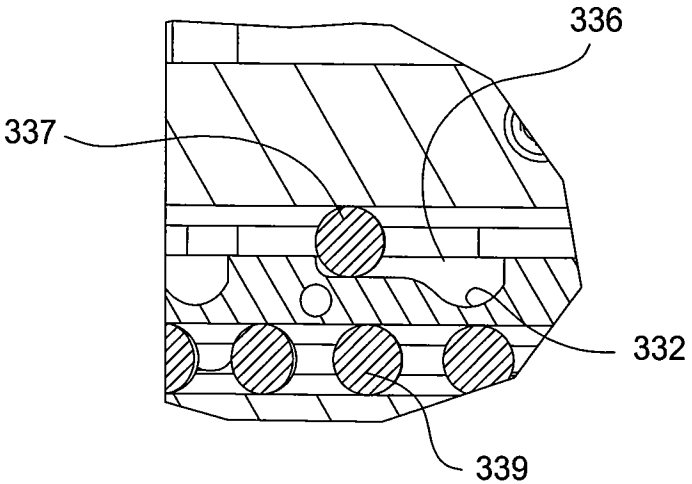
FIG. 7B1

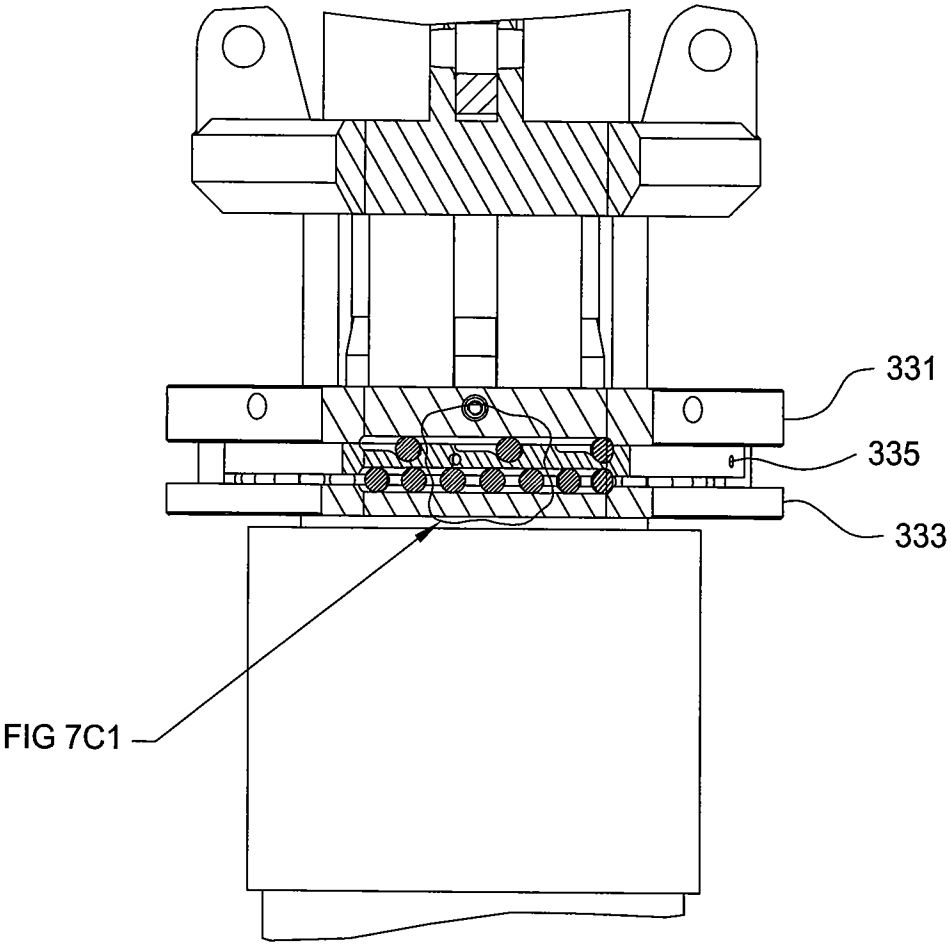
FIG. 7C
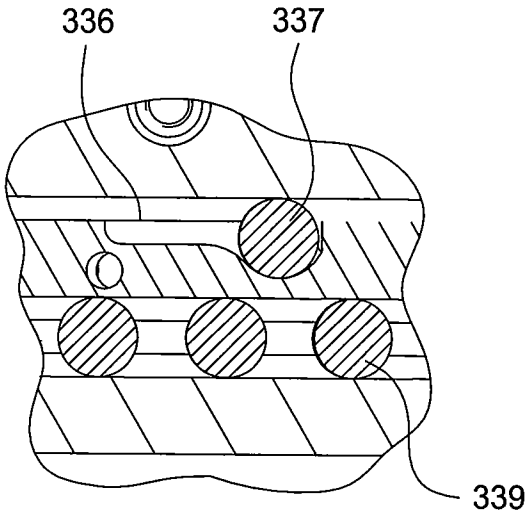
FIG. 7C1

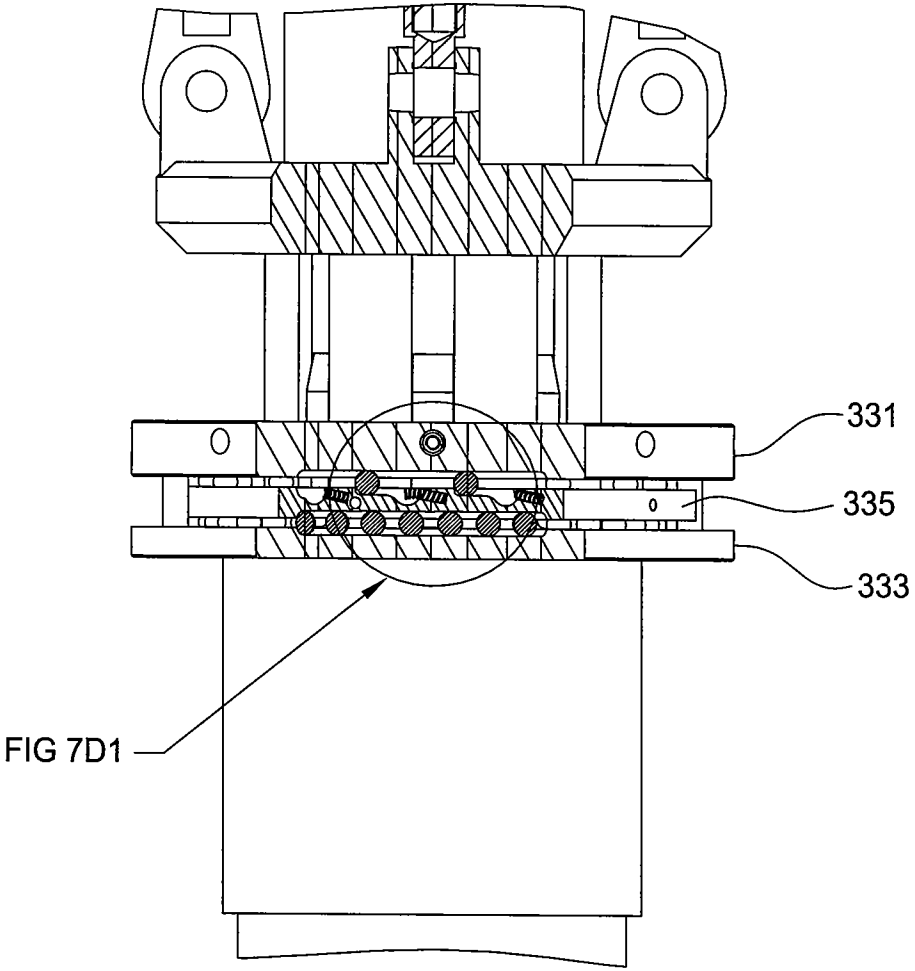
FIG. 7D
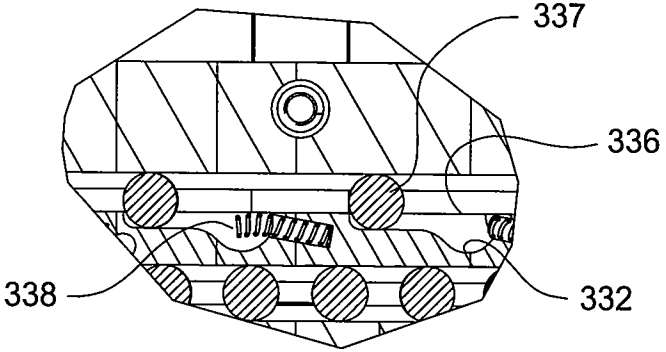
FIG. 7D1

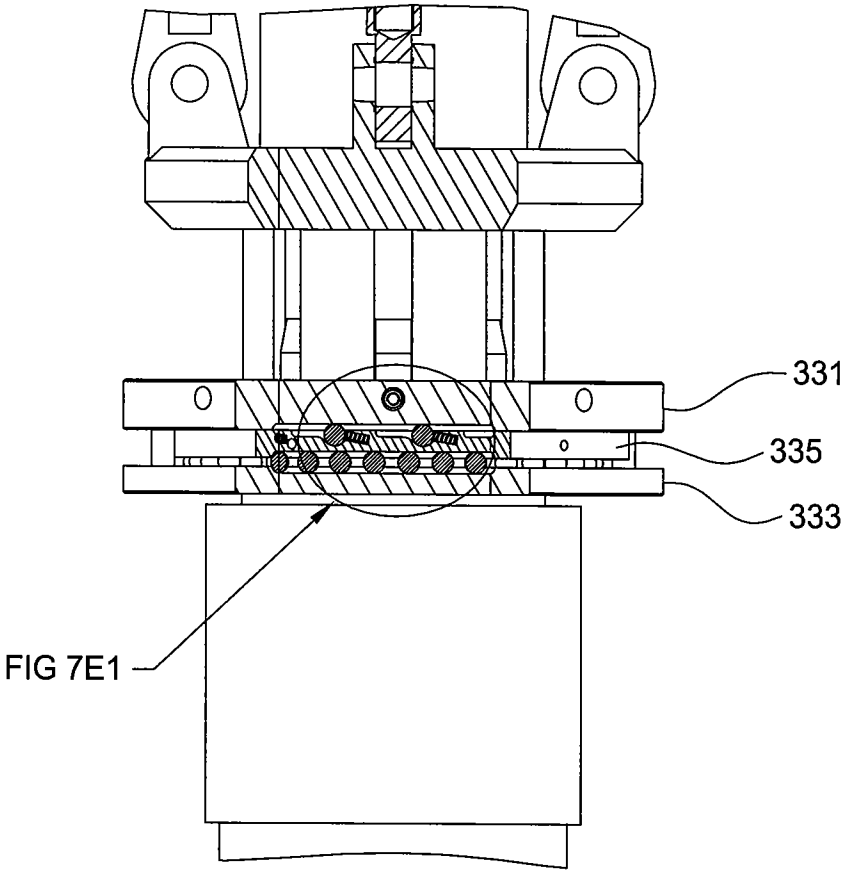
FIG. 7E
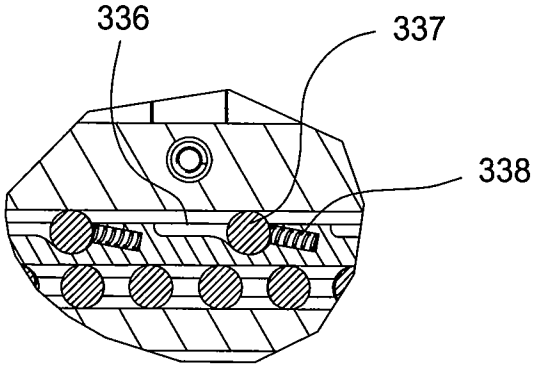
FIG. 7E1

APPARATUS AND METHODS FOR WEDGE LOCK PREVENTION

BACKGROUND OF THE INVENTION

1. Field of the Invention

Embodiments of the present invention relate to methods and apparatus for handling tubulars using top drive systems. Particularly, the invention relates to methods and apparatus for engaging and disengaging a tubular handling apparatus from a tubular. More particularly still, the invention relates to a release mechanism for preventing the gripping elements of a tubular handling apparatus from locking during operations.

2. Description of the Related Art

It is known in the industry to use top drive systems to rotate a drill string to form a borehole. Top drive systems are equipped with a motor to provide torque for rotating the drilling string. The quill of the top drive is typically threadedly connected to an upper end of the drill pipe in order to transmit torque to the drill pipe. Top drives may also be used in a drilling with casing operation to rotate the casing.

In order to drill with casing, most existing top drives require a threaded crossover adapter to connect to the casing. This is because the quill of the top drives is not sized to connect with the threads of the casing. The crossover adapter is design to alleviate this problem. Typically, one end of the crossover adapter is designed to connect with the quill, while the other end is designed to connect with the casing.

In some instances, a tubular handling apparatus having movable gripping elements can be connected below the top drive to grip a tubular, such as casing, so that the tubular handling apparatus and the tubular may be driven axially or rotationally by the top drive. The tubular handling apparatus may be referred to as internal or external gripping tools depending on whether the tool grips an internal or external surface of the tubular.

Some of the tubular handling apparatus may use wedge type slips to grip the tubular. In the case of an internal gripping tool, the wedge slips are moved downward along a mating wedge surface to urge the wedge slips radially outward into contact with the interior surface of the tubular. To increase the gripping force on the tubular, the wedge slips may be provided with teeth on the gripping surface. Generally, the teeth are arranged to point up in order to prevent the tubular from sliding down. This arrangement allows the teeth to "bite" into the tubular in response to the weight of the tubular.

There is a need, therefore, for methods and apparatus for ensuring effective release of the wedge slips from the tubular.

SUMMARY OF THE INVENTION

Embodiments of the present invention provide apparatus and methods for preventing or resolving a wedge lock condition. In one embodiment, the tubular handling apparatus is provided with a wedge lock release mechanism that creates a clearance to allow movement by the mandrel having mating wedge surfaces relative to the tubular to release the wedge slips.

In one embodiment, a release apparatus for releasing a gripping element of a tubular handling apparatus includes an anchor attached to the tubular handling apparatus; an engagement member for engaging the tubular; and an abutment device disposed between the anchor and the engagement member, wherein a distance between the anchor and the abutment device is adjustable to allow axial movement of the engagement member. In another embodiment, the abutment device is adjustable relative to the tubular gripping apparatus.

In another embodiment, a tubular handling apparatus for handling a tubular includes a mandrel; a carrier coupled to the mandrel; a gripping element for engaging the tubular; an engagement member for engaging an upper portion of the tubular; and an abutment device adapted to limit travel of the engagement member, wherein a length of the abutment device is adjustable to allow movement of the engagement member. In yet another embodiment, the tubular handling apparatus includes an anchor attached to the carrier. In yet another embodiment, the abutment device is adjustable relative to the anchor.

In another embodiment, a method of releasing from a wedge lock condition during a tubular handling operation includes providing a tubular handling apparatus having a mandrel, a gripping element movable along the mandrel, and an engagement member for contacting a tubular and attaching a release mechanism to the mandrel, wherein the release mechanism includes an anchor and an abutment device axially movable relative to the anchor. The method also includes engaging the tubular to the engagement member and the engagement member to the abutment device; moving the abutment device away from the tubular; moving the mandrel relative to the engagement member; and releasing the gripping element.

In another embodiment, a release apparatus for releasing a gripping element of a tubular handling apparatus includes an anchor attached to the tubular handling apparatus and an engagement member for engaging the tubular, wherein the position of the engagement member relative to the anchor is selectively adjustable to allow for relative axial movement between the anchor and the tubular.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 6A is a perspective view of the wedge lock release mechanism.

FIG. 6B shows the wedge lock release mechanism of FIG. 6A during normal operations.

FIG. 6C shows the wedge lock release mechanism of FIG. 6A activated to resolve a wedge lock condition.

FIGS. 7A-C illustrate another embodiment of a wedge lock release mechanism having a ball ring. FIG. 7A is a perspective view of the wedge lock release mechanism.

FIGS. 7B and 7B1 show the wedge lock release mechanism of FIG. 7A during normal operations.

FIGS. 7C and 7C1 show the wedge lock release mechanism of FIG. 7A activated to resolve a wedge lock condition.

FIGS. 7D and 7D1 show another embodiment of a wedge lock release mechanism during normal operations.

FIGS. 7E and 7E1 show the wedge lock release mechanism of FIG. 7D activated to resolve a wedge lock condition.

FIG. 8A is a perspective view of the wedge lock release mechanism.

FIG. 8B shows the wedge lock release mechanism of FIG. 8A during normal operations.

FIG. 8C shows the wedge lock release mechanism of FIG. 8A activated to resolve a wedge lock condition.

FIG. 8D is a perspective view of a bolt of the wedge lock release mechanism of FIG. 8A. FIG. 8E is a front view of the bolt of FIG. 8D.

FIG. 11A shows the external gripping tool in an unclamped position. FIG. 11B shows the external gripping tool in a clamped position. FIG. 11C shows the external gripping tool applying a downward force on the tubular. FIG. 11D shows an embodiment of a thread compensator.

FIG. 16 shows the tubular handling apparatus being lowered until the bumper plate engages the casing. FIG. 17 shows the tubular handling apparatus being lowered further. FIG. 18 shows the mandrel relative to the carrier after the lowering of the tubular handling apparatus has stopped. FIG. 19 shows the mandrel is contacting the bumper plate.

DETAILED DESCRIPTION OF THE PREFERRED EMBODIMENT

Tubular handling apparatus may use wedge type slips to grip the tubular. To release the tubular, the wedge slips are retracted along the mating wedge surface to urge the wedge slips radially inward. However, the retraction may cause teeth on the wedge slips to bite into the tubular because the wedge slips are pulled in direction of the teeth. Therefore, it is often desired to move the mandrel containing mating wedge surface slightly downward relative to the tubular before retracting the wedge slips.

A problem may arise when the tubular handling apparatus is equipped with a coupling engagement member such as an engagement plate. In some cases, the engagement plate is fixed to the mandrel of the gripping tool to limit the depth of the insertion of the internal gripping tool into the tubular. If the coupling abuts the engagement plate, the mandrel can no longer be moved downward to facilitate the release of the wedge slips. The wedge slips are thus locked from release.

Embodiments of the present invention generally relate to a release mechanism for preventing the gripping elements of a tubular handling apparatus from locking during operations. In all embodiments, the tools described herein may be connected to a top drive, such that rotation of the top drive rotates the tool and the tubulars that are gripped by the tool. To better understand the novelty of the system of the present invention and the methods of use thereof, reference is hereafter made to the accompanying drawings.

Figure 1:
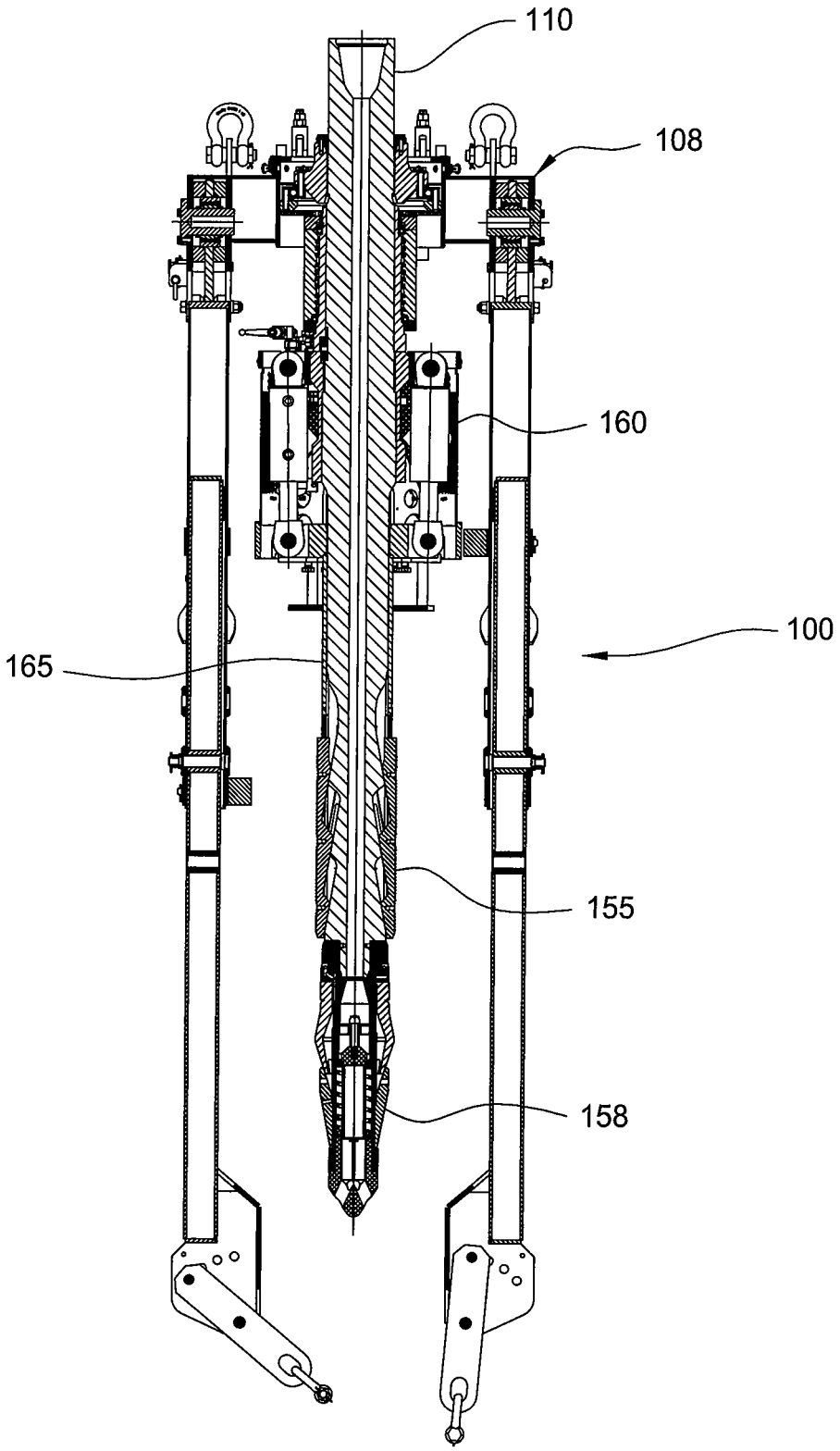
FIG. 1 is a cross-sectional view of an exemplary internal gripping tool.

FIG. 1 is a cross-sectional view of an exemplary internal gripping tool 100. The internal gripping tool includes the mandrel 110, gripping elements 155, and a hydraulic actuator 160 for actuating the gripping elements 155. As shown, the gripping elements 155 are wedge type slips disposed on a mating wedge surface of the mandrel 110. Axial movement of the slips relative to the mandrel 110 urges the slips to move radially outward or inward. The internal gripping tool 100 may optionally be equipped with a fill-up tool 158.

Figure 2:
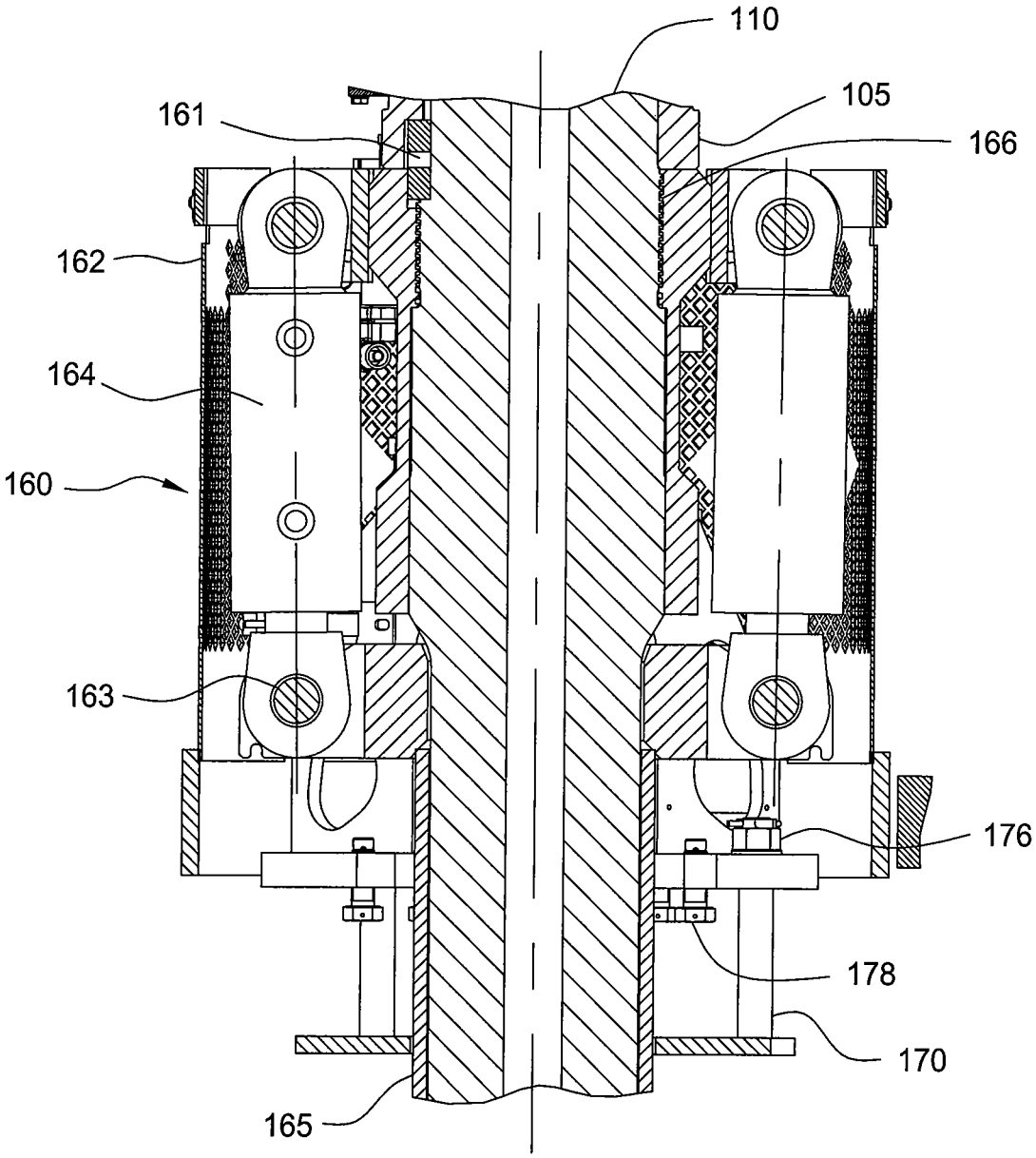
FIG. 2 is an enlarged view of an exemplary hydraulic actuator.

FIG. 2 is an enlarged view of an exemplary hydraulic actuator 160. The actuator 160 includes a housing 162 having a threaded connection to the mandrel 110. The housing 162 may also be secured to the mandrel 110 using a spline connection 161. One or more actuator cylinders 164 attached to the housing 162 using bolts 163 are coupled to an actuator pipe 165. The actuator pipe 165 is connected to the gripping elements 155. Activation of the actuator cylinder 164 urges the axial movement of the actuator pipe 165. In turn, the actuator pipe 165 moves the gripping elements 155 relative to the mandrel 110. A coupling engagement plate 170 (also referred to as a "Bumper Plate") may be coupled to the hydraulic actuator 160. Contact with the casing coupling may cause axial movement of the engagement plate 170. A stop member 178 is provided to limit the travel of the engagement plate 170. Although embodiments of the wedge lock release mechanism will be discussed with reference to the internal gripping tool, it is contemplated that the wedge lock release mechanisms are suitable for use with an external gripping tool. Exemplary suitable internal or external gripping tools are disclosed in U.S. patent application Ser. No. 12/435,346, filed on May 4, 2009, entitled "Tubular Handling Apparatus" by M. Liess, et al., which application is incorporated herein by reference in its entirety.

Figure 3:
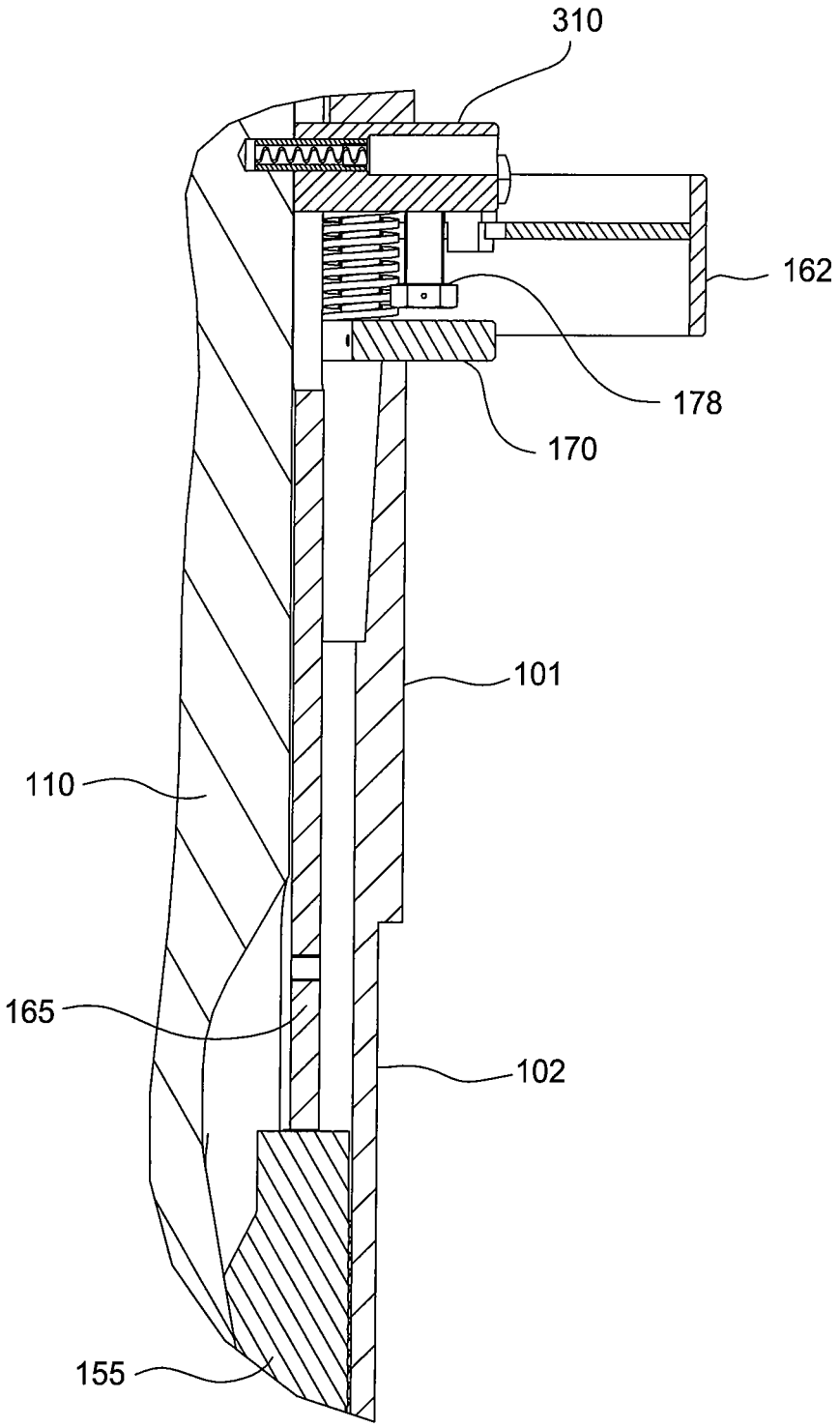
FIG. 3 shows an exemplary wedge lock release mechanism using a height adjustable stop member.
Figure 4:
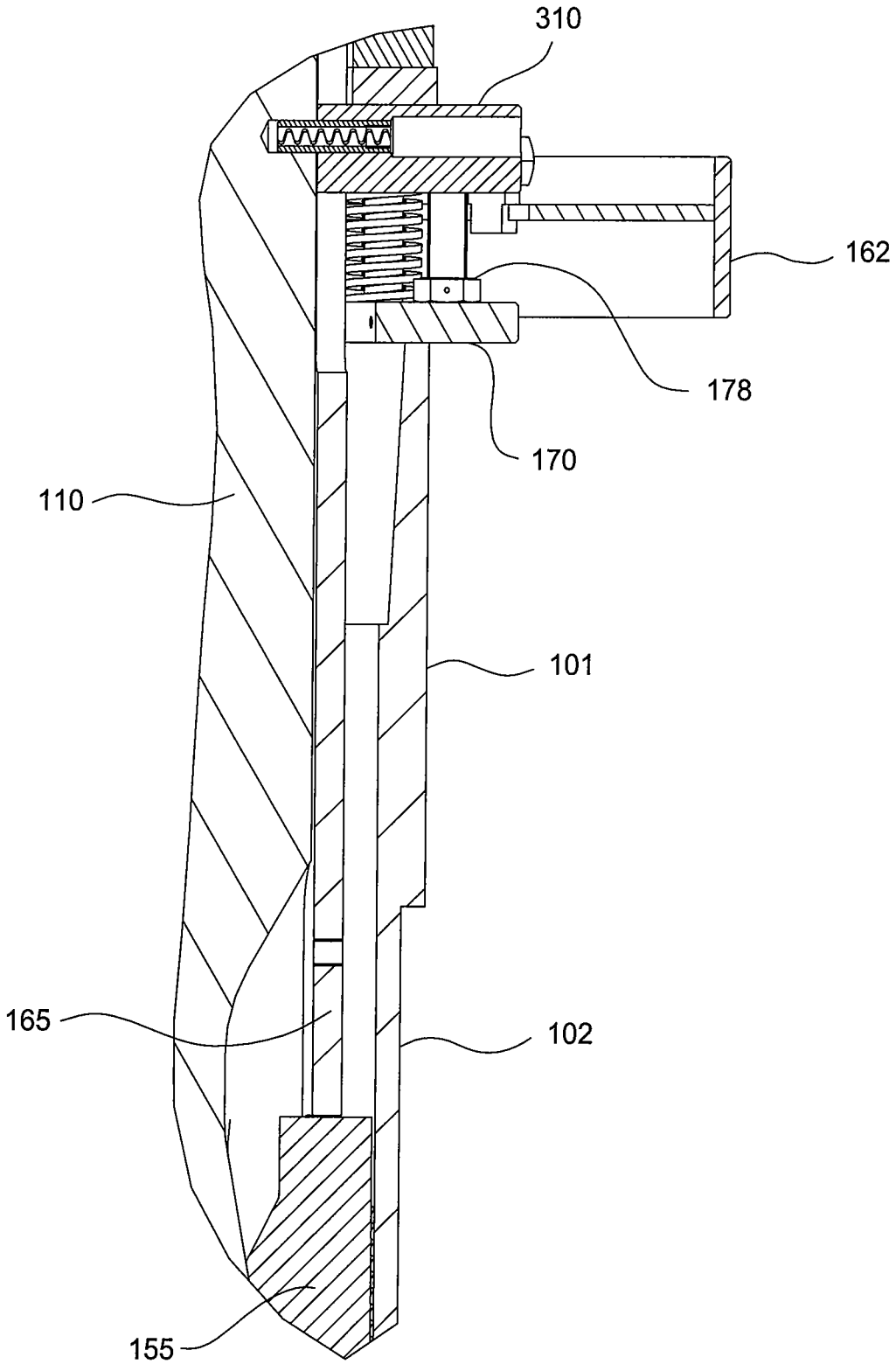
FIG. 4 shows the wedge lock release mechanism of FIG. 3 during normal operations.
Figure 5:
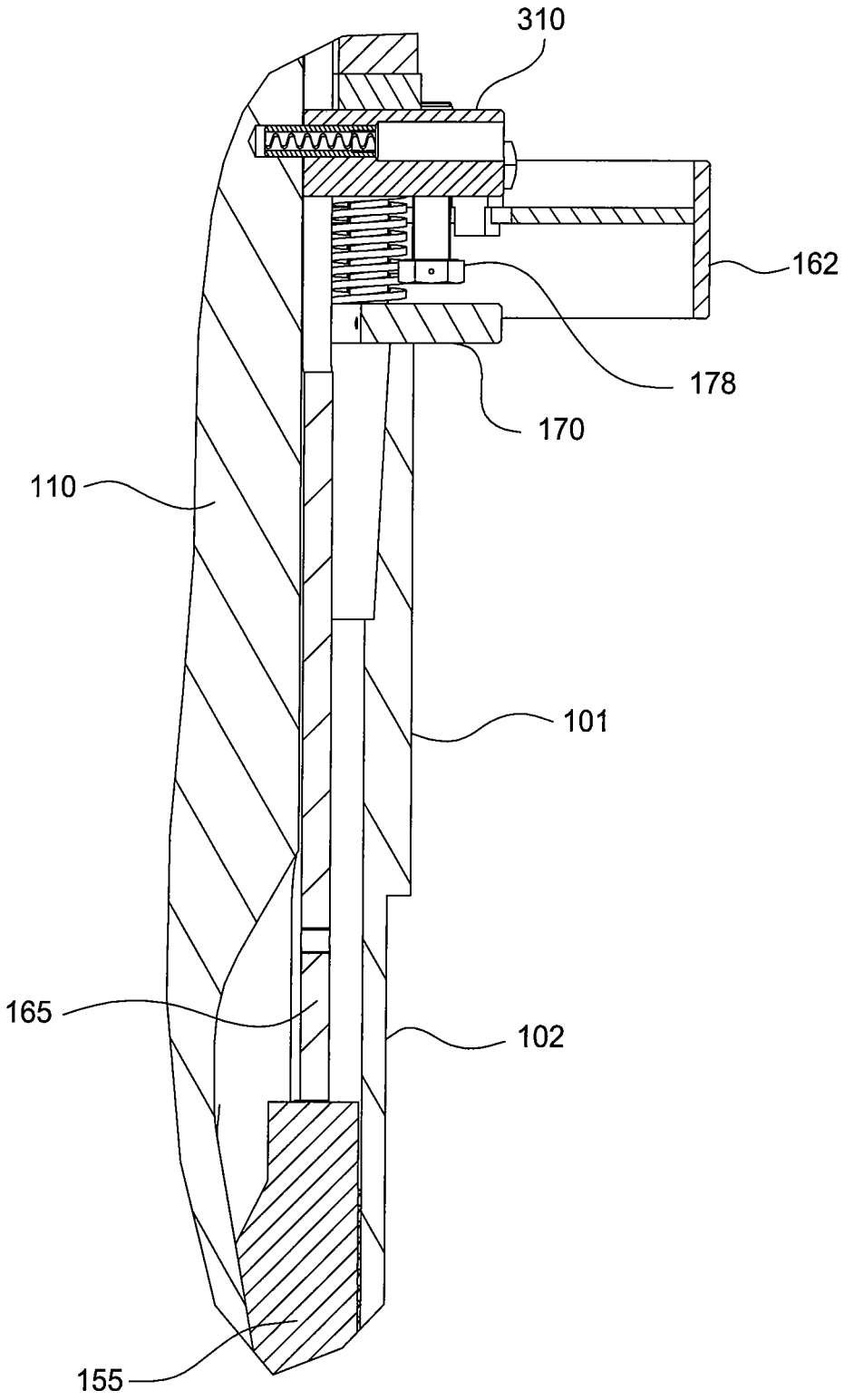
FIG. 5 shows the wedge lock release mechanism of FIG. 3 activated to resolve a wedge lock condition.

FIG. 3 shows an exemplary wedge lock release mechanism using a height adjustable stop member. As shown, the mandrel 110 and the gripping elements 155 are disposed in the tubular 102 and the gripping elements 155 have been actuated into engagement with the tubular 102. In this position, the actuator pipe 165 has extended the gripping elements 155 along the mating wedge surfaces of the mandrel 110, thereby extending the gripping elements 155 radially outward into engagement with tubular 102. A stop member 178 is connected to an anchor 310 for attachment to the mandrel 110. Alternatively, the anchor 310 may be attached to the housing 162 of the hydraulic actuator 160, which in turn is attached to the mandrel 110. In FIGS. 3-5, the stop member 178 is a screw that is attached to the anchor 310. The screw has a first length extending from the anchor 310. The engagement plate 170 is positioned at a distance away from the end of the stop member 178 and is movable relative to the stop member 178. In one embodiment, the engagement plate 170 is biased away from the anchor 310 using a biasing member such as a spring. As shown, the coupling 101 of the tubular 102 is in contact with the engagement plate 170. The clearance between the engagement plate 170 and the stop member 178 exists under standard operating conditions. The clearance allows the mandrel 110 to move relative to the gripping elements 155 to release the gripping elements 155.

In some instances, it may be desirable to apply a downward force on the tubular 102. Application of this force may cause the mandrel 110 and the wedge slips to slide down relative to the tubular 102. This relative movement causes the stop member 178 to contact engagement plate 170, thereby eliminating the clearance, as illustrated in FIG. 4. As a result, the mandrel 110 is prevented from moving downward relative to the tubular 102, and thus, locking the gripping elements 155 from release.

When this condition occurs, the stop member 178 may be adjusted to create a clearance. As shown in FIG. 5, the screw may be released to adjust the height of the screw extending from the anchor 310. For example, the screw may be rotated to retract from the engagement plate 170. In this respect, a clearance is created to allow the mandrel 110 to move axially relative to the tubular 102 to facilitate the release of the gripping elements 155. In another embodiment, stop member may be a bolt, pin, a retractable elongated member, or other suitable height adjustable stop member. It is also contemplated that the stop member is removable. In this respect, if the wedge lock condition occurs, the stop member may be removed to create the clearance.

Figure 6A:
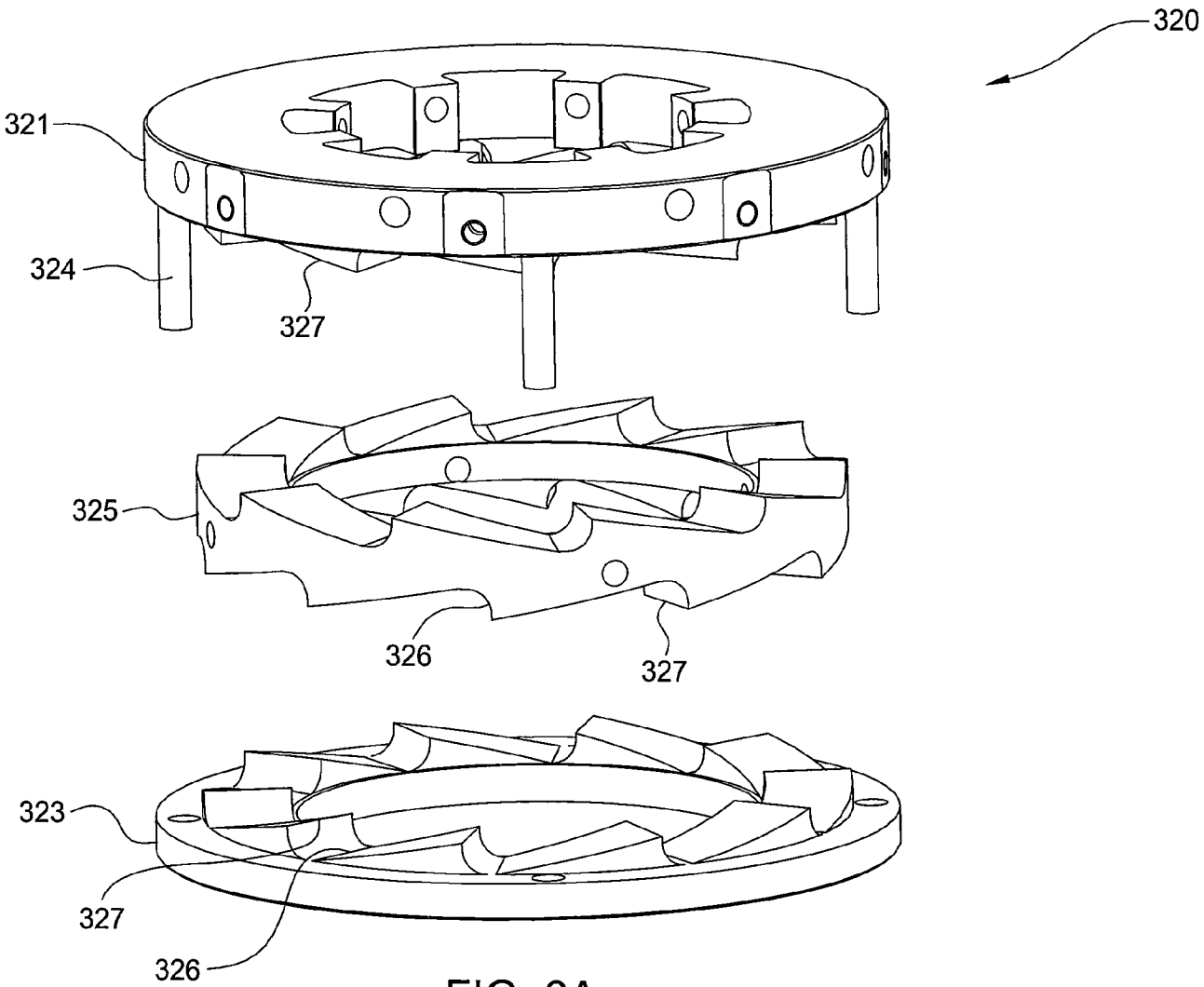
FIGS. 6A-6C illustrates another embodiment of a wedge lock release mechanism having a tapered ring.
Figure 6B:
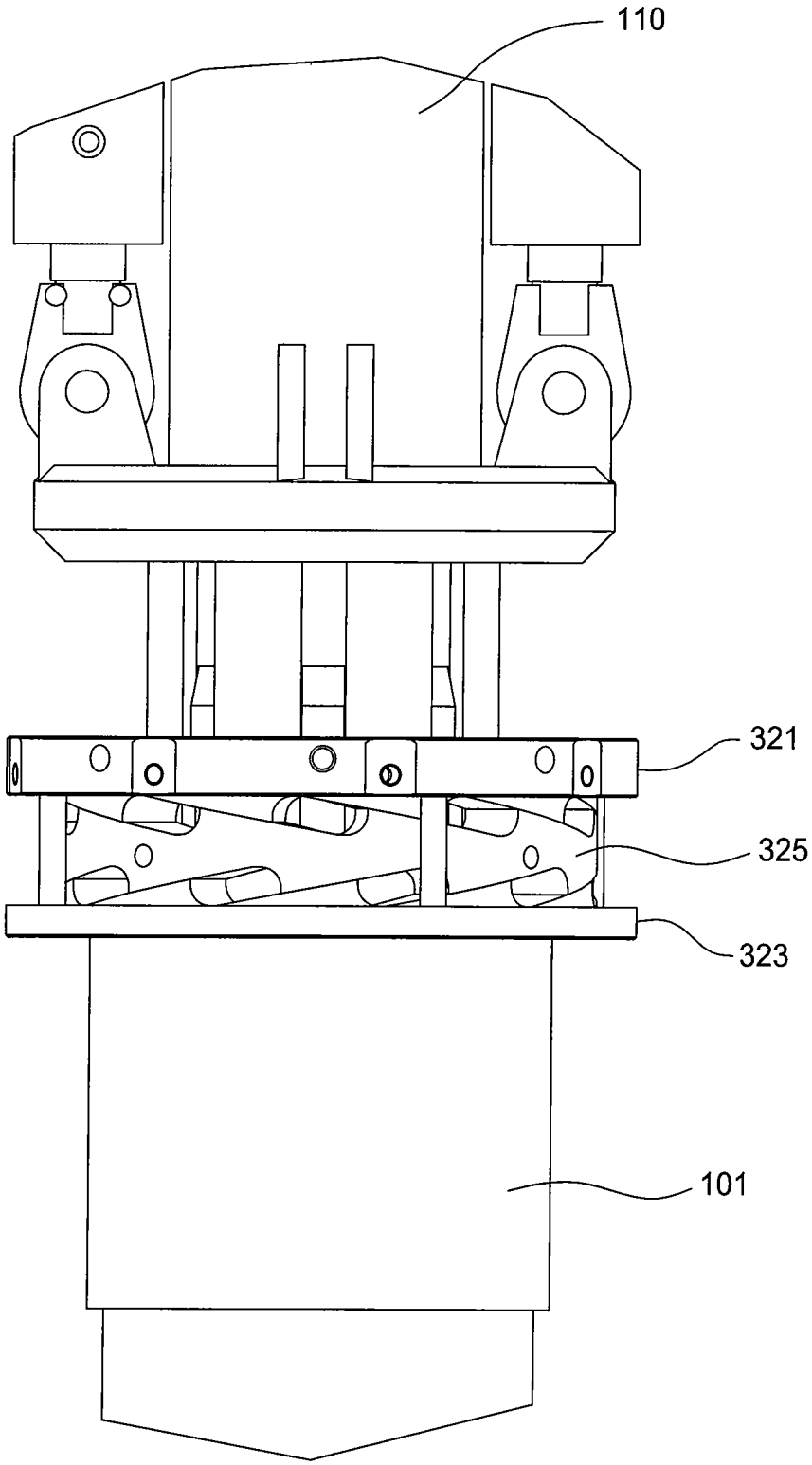
Figure 6C:
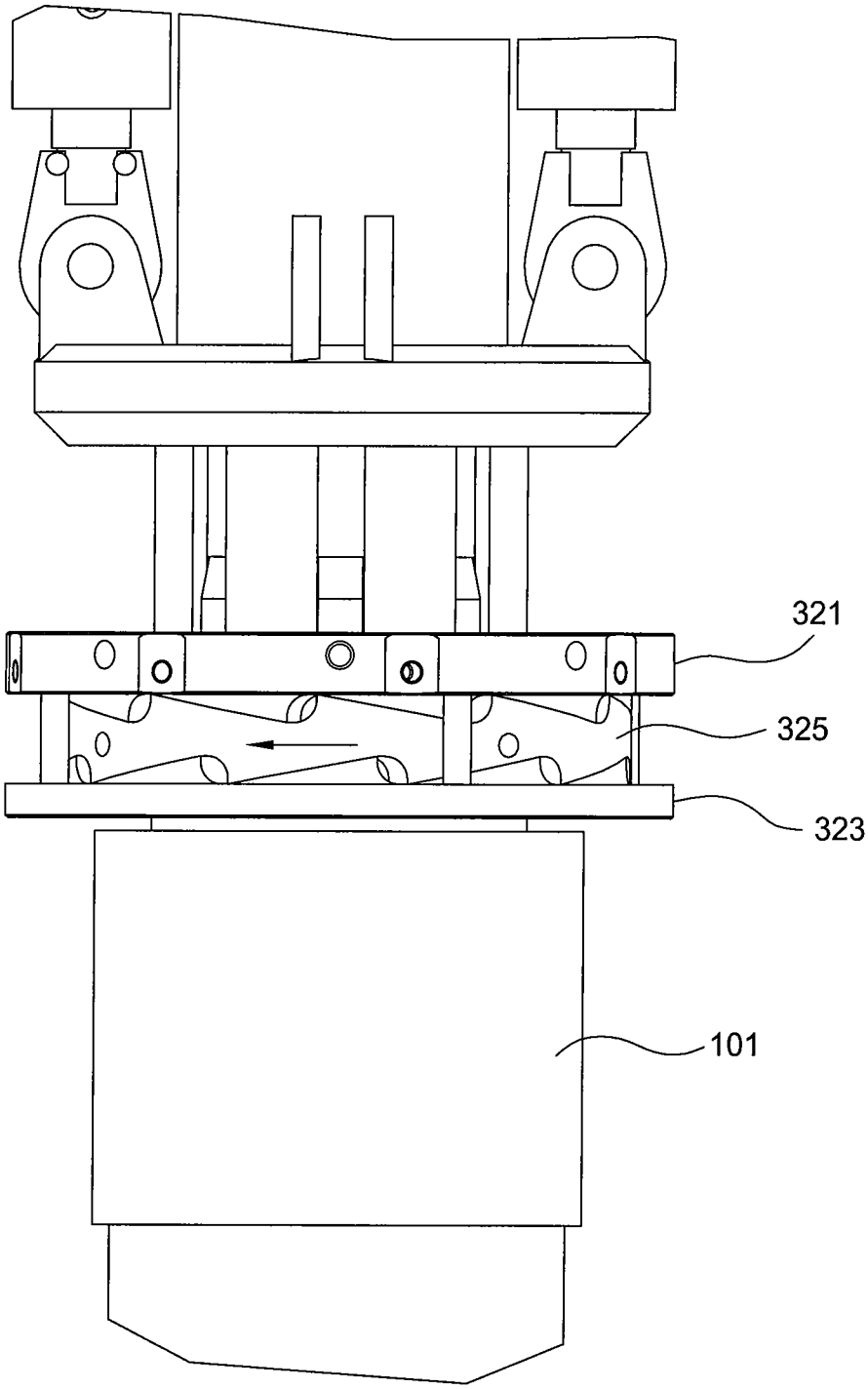

FIGS. 6A-6C illustrates another embodiment of a wedge lock release mechanism 320. In this embodiment, the wedge lock release mechanism 320 has a ring shaped anchor 321 attached to the mandrel 110 using a spline connection. The anchor 321 may be secured to the mandrel 110 using radially inserted pins or screws. The tubular coupling engagement member 323 is also ring shaped and is coupled to the anchor 321 using a guide rod 324. The guide rod 324 allows the engagement member 323 to move axially relative to the anchor 321. A tapered ring 325 is disposed between the engagement member 323 and the anchor 321. The upper and lower contact surfaces of the tapered ring 325 have alternating tapers that mate with complementary taper surfaces on the anchor 321 and the engagement member 323. Each taper may have a crest 327 and a recess 326. FIG. 6B shows the release mechanism 320 at normal operating height. The crest 327 of the tapered ring 325 is engaged with a corresponding crest 327 of the anchor 321 or the engagement plate 323.

FIG. 6B presents a wedge lock condition in which the coupling 101 is contacting the engagement member 323. In turn, the engagement member 323 is in contact with the tapered ring 325, which is in contact with the anchor 321. In this respect, a clearance does not exist to allow the mandrel 110 to move relative to the coupling 101, and thus, presenting a wedge lock condition. To release the wedge lock, the tapered ring 325 may be rotated, in this embodiment, to the left of the anchor 321 and the engagement member 323, such that the crest 327 of the taper surface of the tapered ring 325 mates with a corresponding recess 326 of the taper surface on the anchor 321 or the engagement member 323, as shown in FIG. 6C. In this respect, the overall height of the release mechanism 320 may be reduced, thereby creating the clearance for movement of the mandrel 110 to release the gripping elements 155. In another embodiment, the release mechanism 320 has an anchor coupled directly to the engagement member. The height of the release mechanism is adjustable by rotating either the anchor or the engagement member. In yet another embodiment, the tapered ring only one tapered surface for engagement with the anchor 321 or the engagement member 323.

Figure 7A:
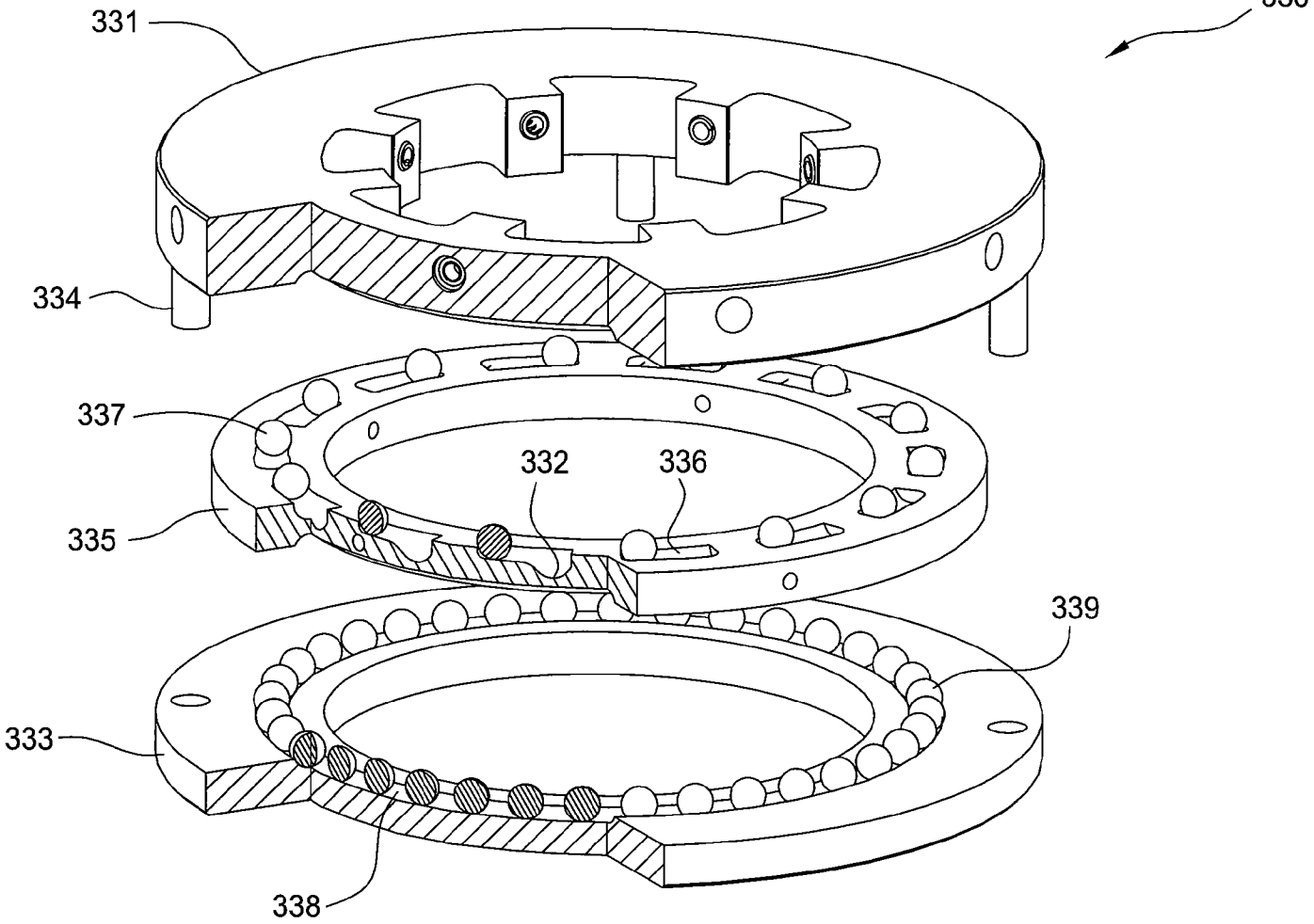

FIGS. 7A-C illustrate another embodiment of a wedge lock release mechanism 330. In this embodiment, the wedge lock release mechanism 330 has a ring shaped anchor 331 attached to the mandrel 110 using a spline connection. The anchor 331 may be secured to the mandrel 110 using radially inserted pins or screws. The coupling engagement member 333 is also ring shaped and is coupled to the anchor 331 using a guide rod 334. The guide rod 334 allows the engagement member 333 to move axially relative to the anchor 331. A ball ring 335 is disposed between the engagement member 333 and the anchor 331. A first set of balls 337 may be disposed between the engagement member 333 and the ball ring 335 to facilitate relative movement therebetween. A lower groove 338 for retaining the balls may be formed on the engagement member 333 and/or the ring 335. A second set of balls 337 may be disposed between the anchor 321 and the ring 335. The upper groove 336 on the ball ring 335 may be segmented such that each segment 336 is retaining one ball. Each groove segment 336 may have a pocket 332 disposed at an end of the groove segment 336. The pocket 332 is recessed from the groove segment 336 such that a ball in the pocket 332 is at a lower height than a ball in the groove segment 336. The anchor 331 may have a circular groove for interacting with the balls 337 in the groove segment 336. FIGS. 7B and 7B1 show the release mechanism 330 under normal operating height. As shown, the balls 337 between the ball ring 335 and the anchor 321 are disposed in the groove segment 336, not the pocket 332.

FIG. 7B presents a wedge lock condition in which the coupling 101 is contacting the engagement member 333. In turn, the engagement member 333 is in contact with the ball ring 335, which is in contact with the anchor 331 via the balls 337. In this respect, a clearance does not exist to allow the mandrel 110 to move relative to the coupling 101. To release the wedge lock, the ball ring 335 may be rotated, in this embodiment, to the left, such that the balls 337 between the ring 325 and the anchor 321 are moved from the groove segment 336 and disposed in one or more pockets 332, as shown in FIGS. 7C and 7C1. With the balls 337 sitting in the pocket 332, the overall height of the release mechanism 330 is reduced, thereby creating the clearance for movement of the mandrel 110 to release the gripping elements 155. In addition or alternatively, groove segments may be formed between the ball ring 335 and the engagement member 333.

FIGS. 7D and 7D1 show another embodiment of the wedge lock release mechanism. The release mechanism may include a spring 338 adapted to push the ball 337 out of the pocket 332, thereby returning the ball 337 to the top position on the groove segment 336. FIGS. 7D and 7D1 show the ball 337 in the groove segment 337 and the spring 338 in the extended position. FIG. 7D also presents a wedge lock condition. To resolve the wedge lock condition, the ball ring 335 is rotated to move the balls 337 into the pocket 332. As seen in FIGS. 7E and 7E1, the balls 337 are sitting in the pocket 332 and have compressed the spring 338, thereby reducing the height of the release mechanism. The decrease in height creates a clearance between engagement member 333 and the coupling 101 to facilitate the release of the gripping elements.

Figure 8A:
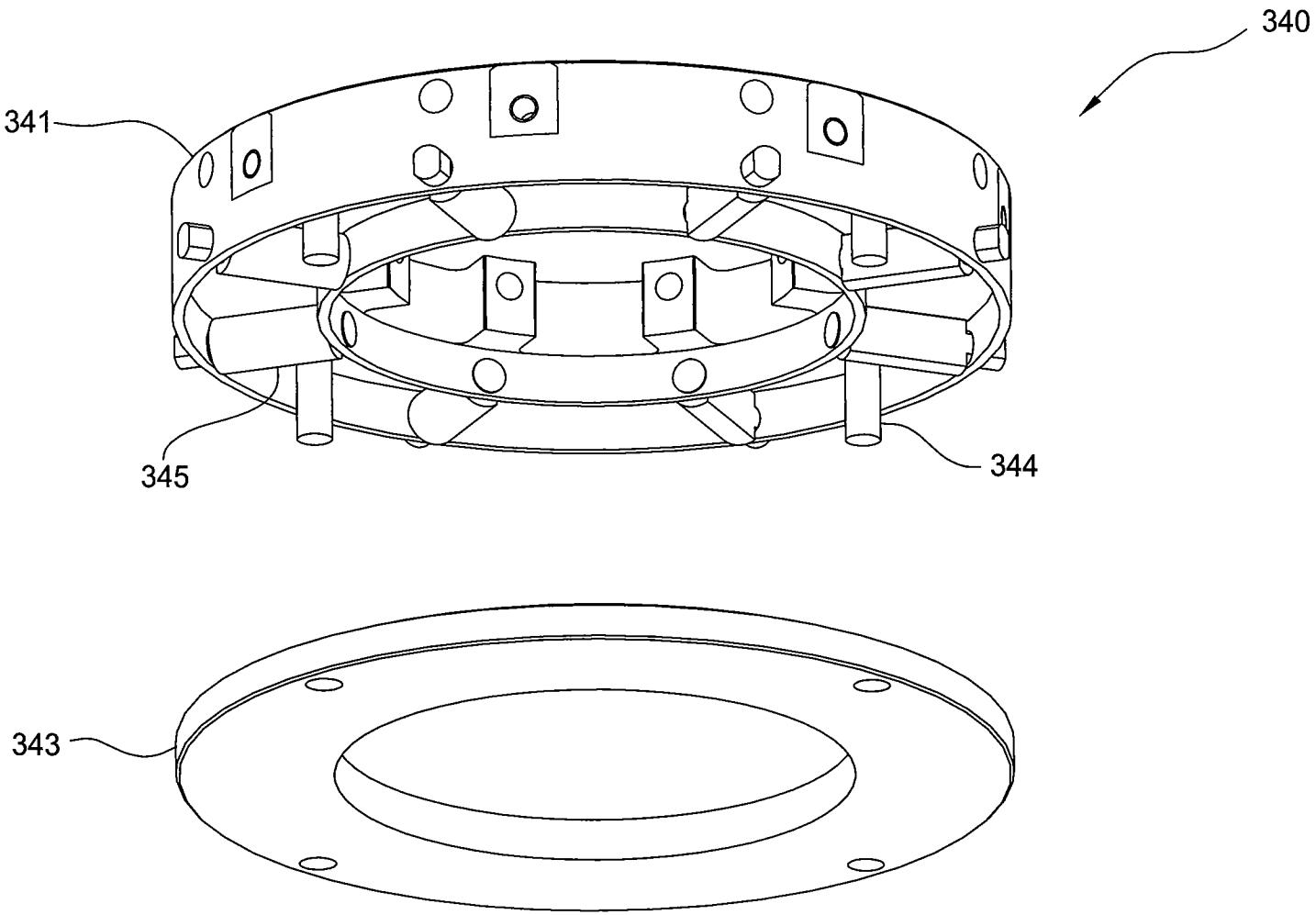
FIGS. 8A-8E illustrate another embodiment of a wedge lock release mechanism having an eccentric bolt.
Figure 8B:
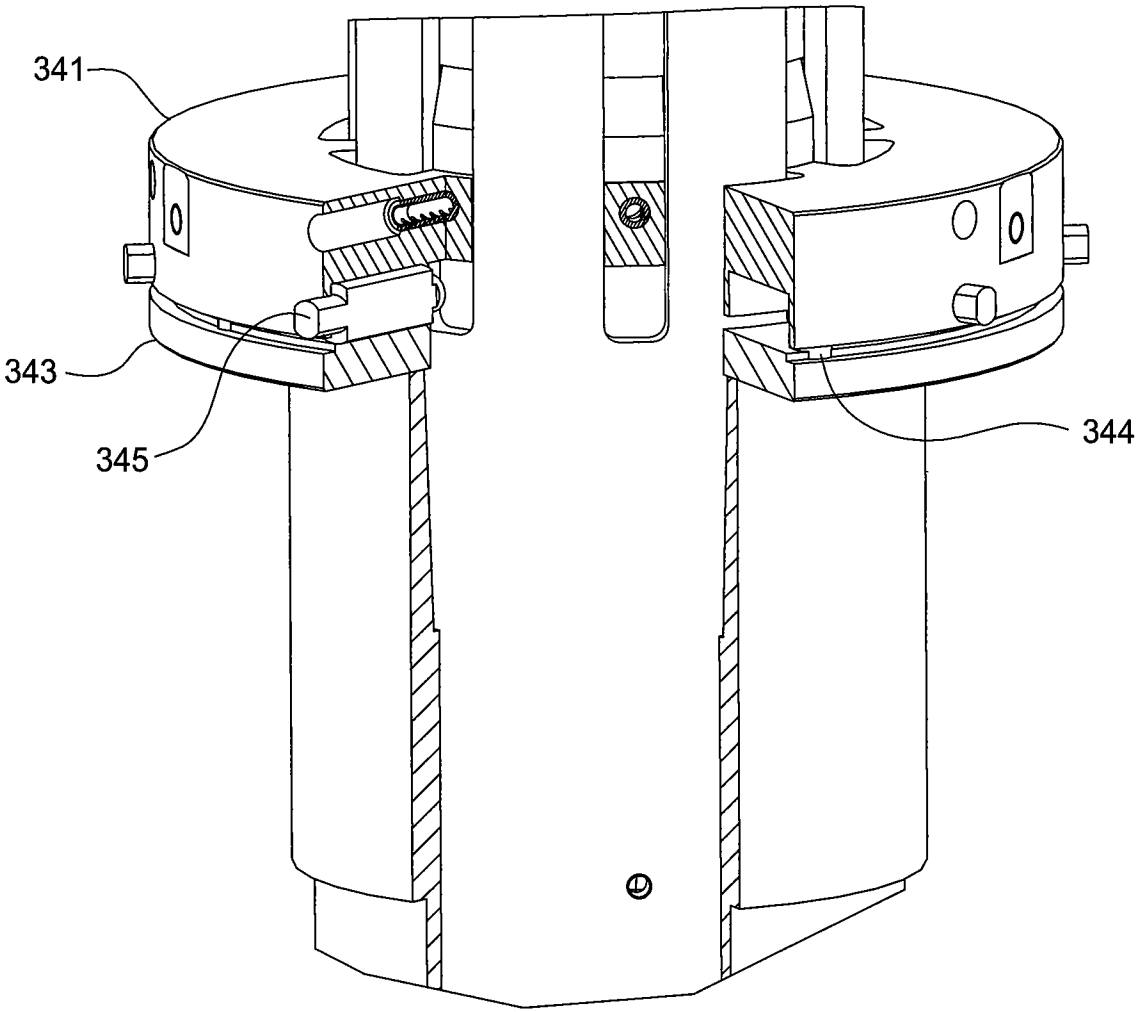
Figure 8C:
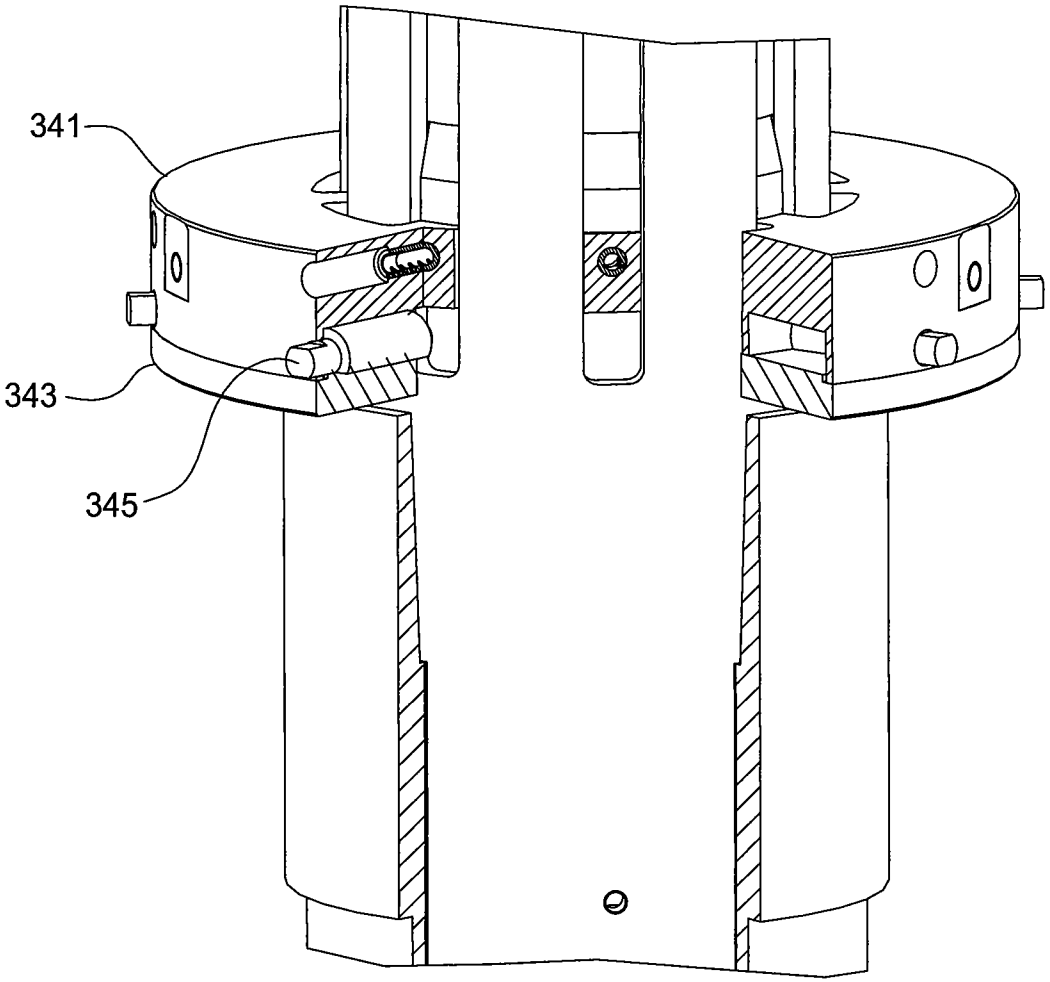
Figure 8E:
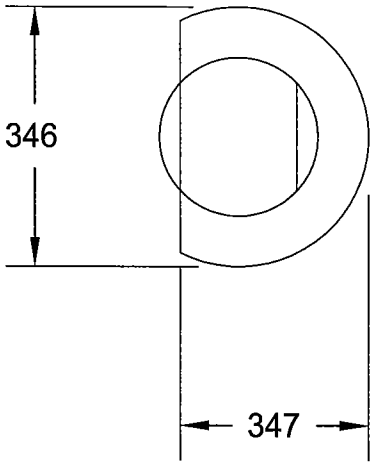
Figure 8D:
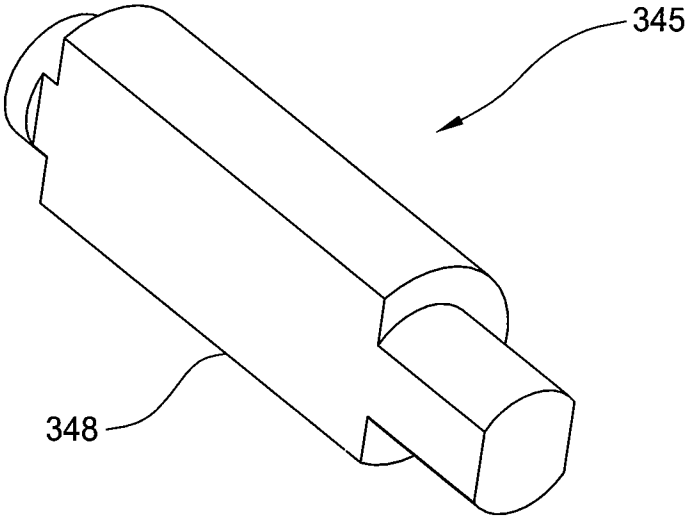

FIGS. 8A-D illustrate another embodiment of a wedge lock release mechanism 340. In this embodiment, the wedge lock release mechanism 340 has a ring shaped anchor 341 attached to the mandrel 110 using a spline connection. The anchor 341 may be secured to the mandrel 110 using radially inserted pins or screws. A coupling engagement member 343 is also ring shaped and is coupled to the anchor 341 using a guide rod 344. The guide rod 344 allows the engagement member 343 to move axially relative to the anchor 341. A plurality of eccentric bolts 345 are rotatably coupled to the anchor 341. Each bolt 345 has a first end and a second end rotatably coupled to the anchor 341 and may act as axles for the bolt 345. The body 348 between the two ends has an eccentric cross-section. In one embodiment, the body 348 has a first cross-sectional thickness 346 that is greater than a second thickness 347, as illustrated in FIG. 8E. As shown, the body 348 has an arcuate shape that extends over 180 degrees. The two ends of the arcuate shaped are connected by a flat surface. During normal operations, the bolt 345 is positioned such that the longer first thickness 346 is aligned with the axis of the tubular and that the dimension of the first thickness 347 is selected so that a lower end of the first thickness 346 extends below the anchor 341, as illustrated in FIG. 8B. In this respect, the engagement member 343 would contact the bolt 345 instead of the anchor 341, thereby providing a clearance between the anchor 341 and the engagement member 343. The dimension of the shorter second thickness 347 may be selected such that when the bolt 345 is rotated to move the shorter second thickness 347 in axial alignment with the tubular, the engagement member 343 may directly contact the anchor 341, as illustrated in FIG. 8C.

FIG. 8B presents a wedge lock condition in which the coupling 101 is in contact with the engagement member 343. As show, the coupling 101 is in contact with the engagement member 343, which is in contact with the bolt 345. A clearance does not exist to allow the mandrel 110 to move relative to the coupling 101. To release the wedge lock, the bolts 345 may be rotated such that the shorter second side is in the axial position. In this embodiment, the bolts 345 are rotated such that the flat surface is facing the engagement member 343, as shown in FIG. 8C. In this respect, the engagement member 343 is allowed to move closer toward the anchor 341, thereby reducing the overall height of the release mechanism 340. In this manner, a clearance between the engagement member 343 and the coupling 101 may be created for movement of the mandrel 110 to release the wedge.

Figure 9A:
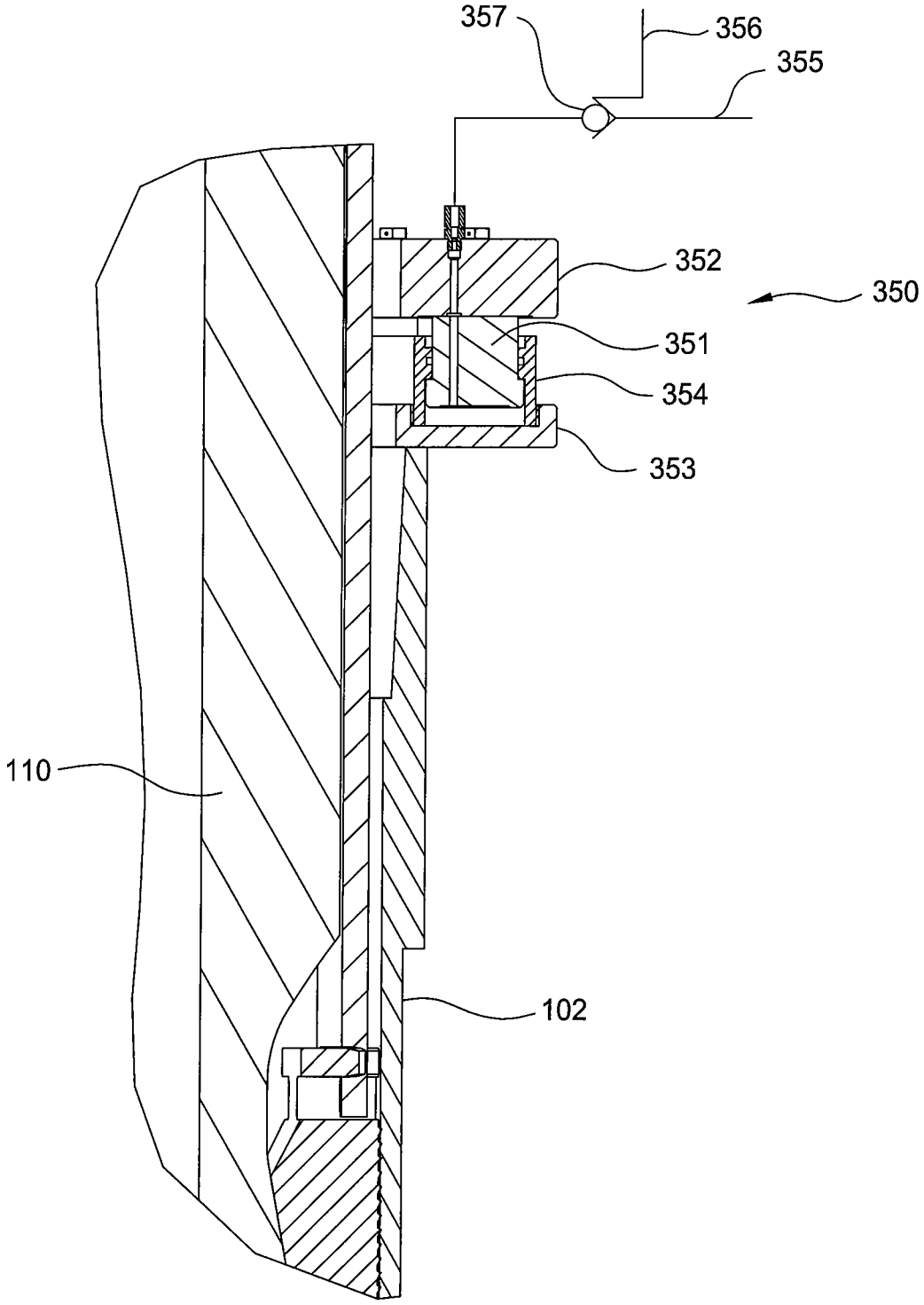
FIG. 9A shows another embodiment of a wedge lock release mechanism of during normal operations.
Figure 9B:
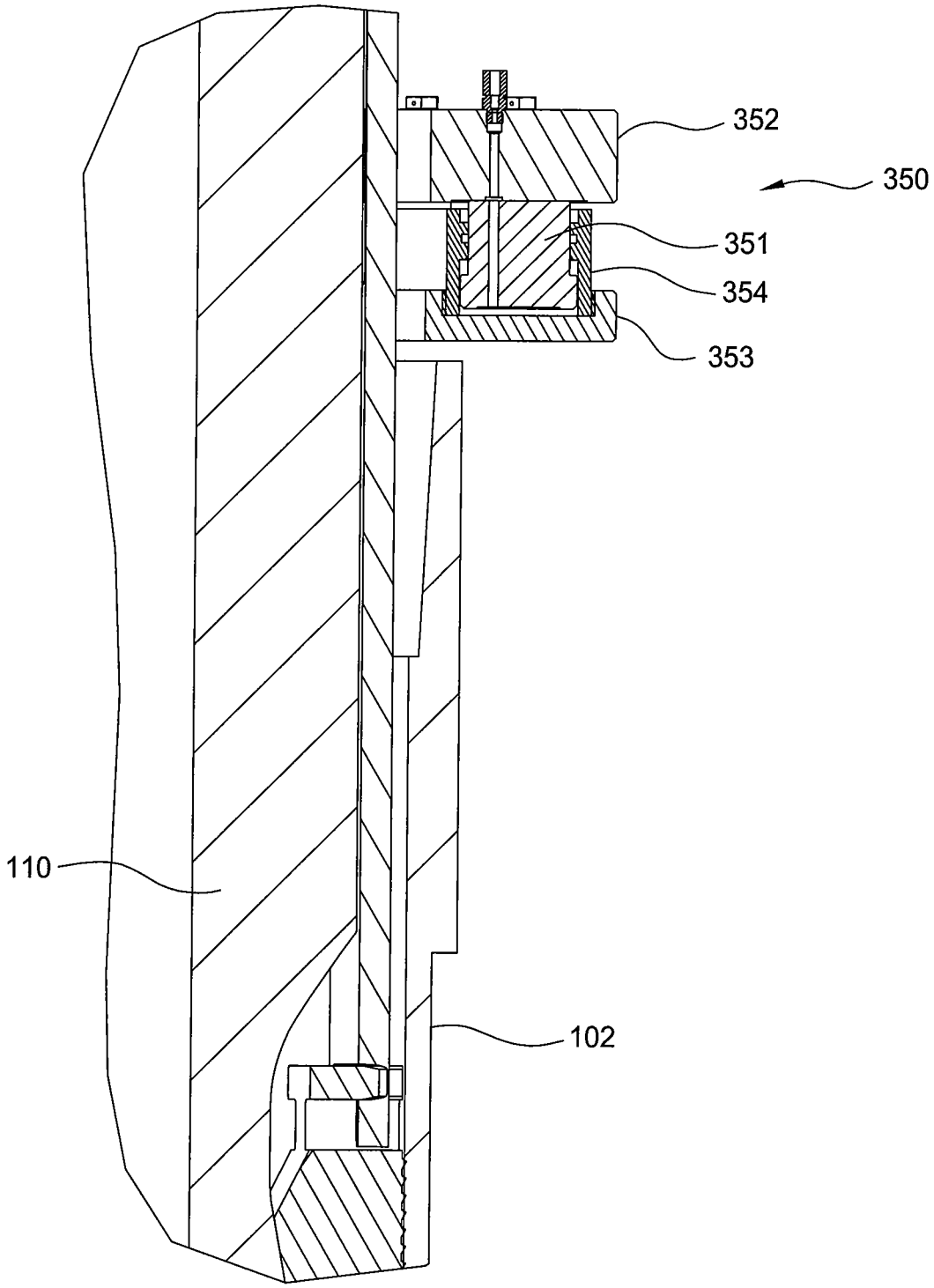
FIG. 9B shows the wedge lock release mechanism of FIG. 9A activated to resolve a wedge lock condition.

FIGS. 9A-9B illustrate another embodiment of a wedge release mechanism. In this embodiment, the wedge lock release mechanism is a piston and cylinder assembly 350 attached to the mandrel 110. The piston 351 is attached to the anchor 352, and the cylinder 354 is attached to the engagement plate 353. Alternatively, the lower portion of the cylinder may act as the engagement plate. A fluid path 355 exists to introduce or release a fluid in the fluid chamber of the cylinder 354. In one embodiment, the fluid path 355 may be connected to the release line 356 of the cylinder 164. As shown in FIG. 9A, the cylinder 354 is in the extended position and is locked by a check valve 357. A clearance is not present to allow the release of the gripping elements 155. To release the wedge lock, fluid in the cylinder 354 is relieved through the check valve 357. This allows the cylinder 354 and the engagement plate 353 to move upward to provide a clearance to release the gripping elements 155, as shown in FIG. 9B. It can be seen in FIG. 9B that the fluid chamber has decreased in size. In another embodiment, the check valve 357 may be opened by the release of the clamping cylinders 164. Initially, the clamping cylinder is released to retract the gripping elements 155 and tubular 102 against the engagement plate 353. Because fluid path 355 is in communication with the release line 356, the pressure inside the release line 356 opens the check valve 357. It is contemplated that one or more piston and cylinder assemblies may be positioned around the mandrel. It is also contemplated that the cylinder may be an annular cylinder around the mandrel. It is further contemplated the cylinder is attached to the anchor and the piston is attached to the engagement plate.

Figure 10A:
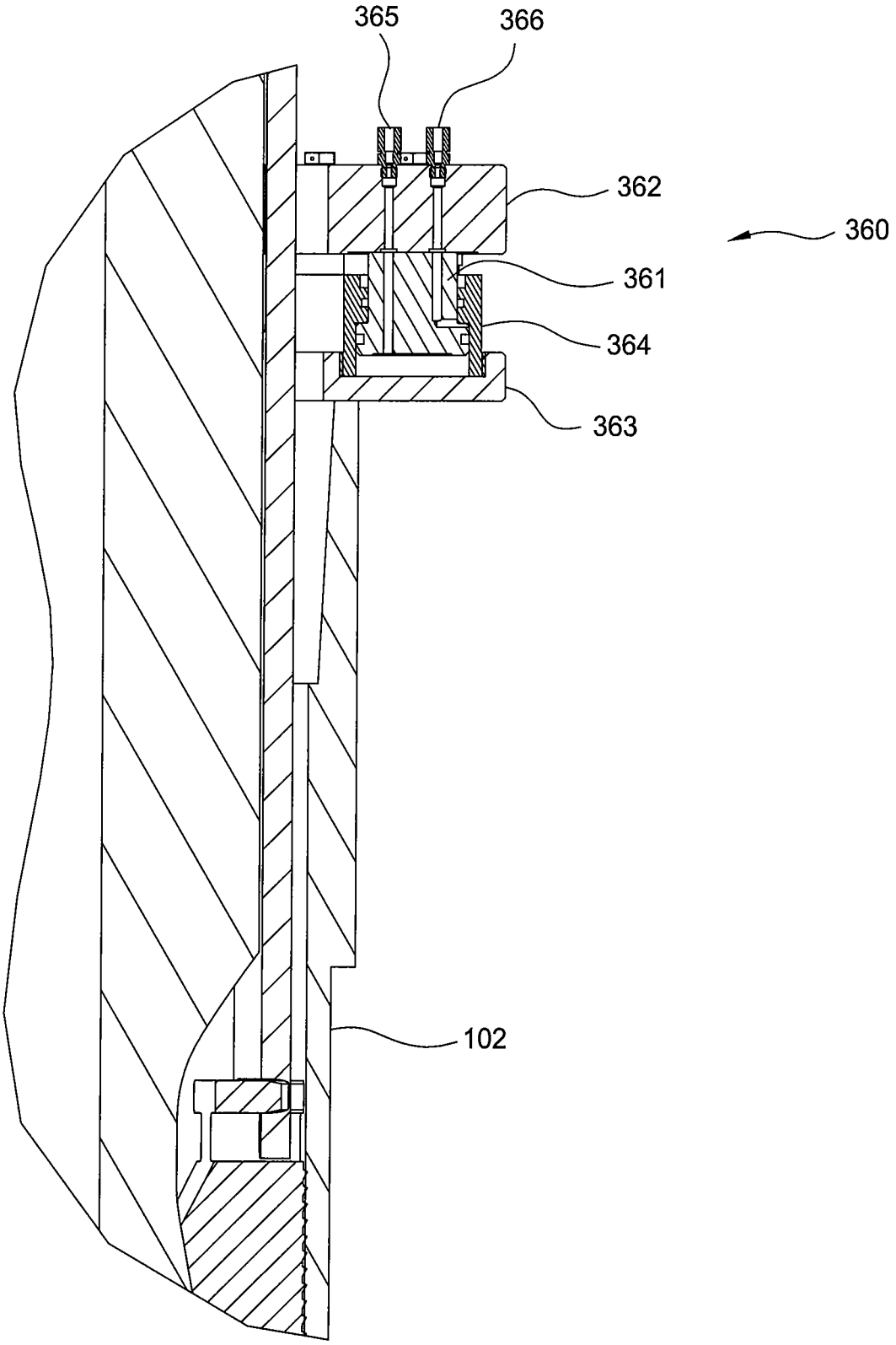
FIG. 10A shows another embodiment of a wedge lock release mechanism of during normal operations.
Figure 10B:
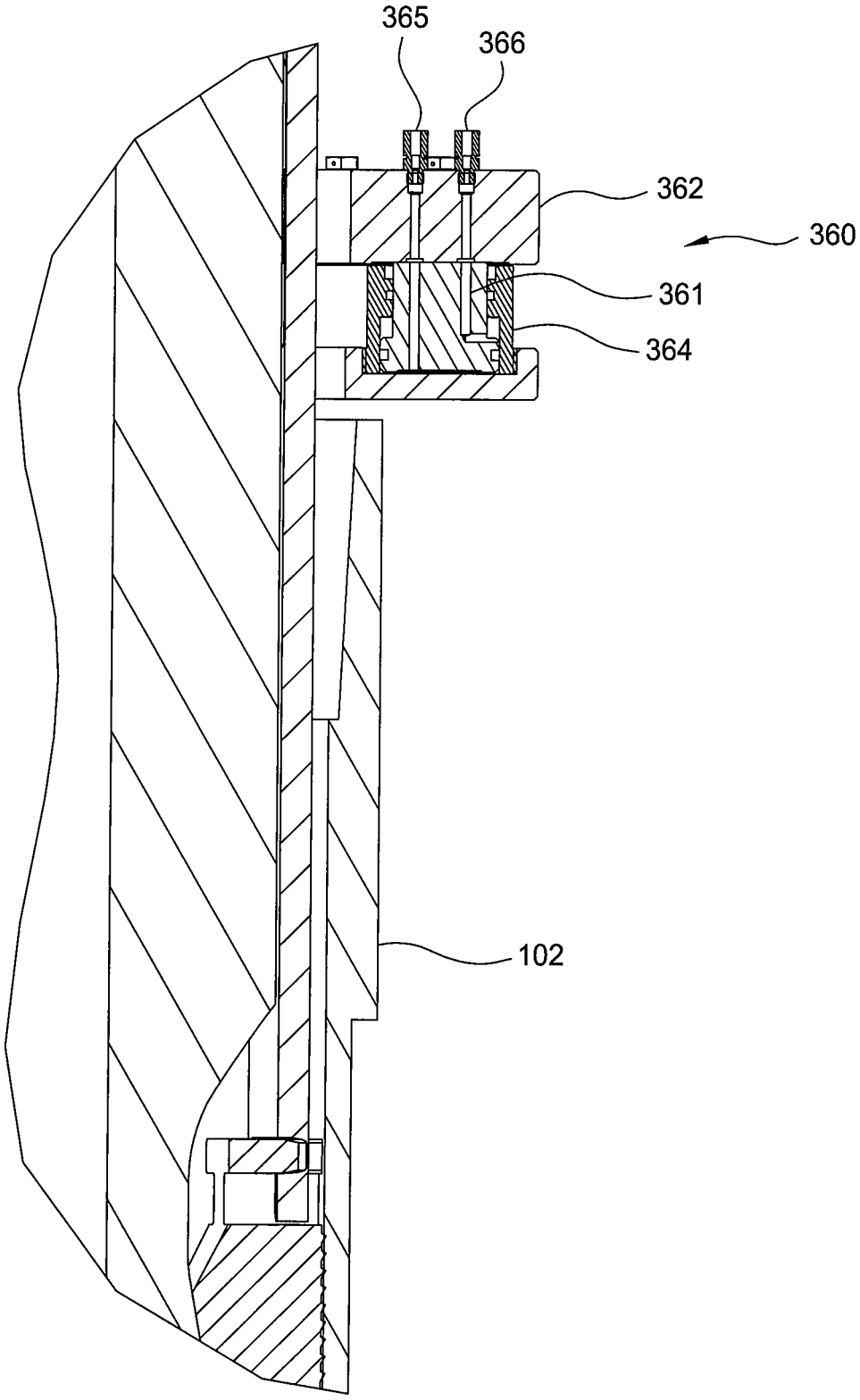
FIG. 10B shows the wedge lock release mechanism of FIG. 10A activated to resolve a wedge lock condition.

FIGS. 10A-10B illustrate another embodiment of a wedge release mechanism. In this embodiment, the wedge lock release mechanism is a piston and cylinder assembly 360 attached to the mandrel 110. The piston 361 is attached to the anchor 362, and the cylinder 364 is attached to the engagement plate 363. The assembly 360 includes an extension fluid path 365 for extending the cylinder 364 and a retraction fluid path 366 for retracting the cylinder 364. As shown in FIG. 10A, the cylinder 354 is in the extended position and a clearance between the engagement plate 363 and the coupling of the tubular 102 is not present to allow the release of the gripping elements 155. To release the wedge lock, fluid is supplied through the retraction fluid path 366, and the extension fluid path 365 is opened. This operation will lift the cylinder 364 up relative to the piston 361 to provide clearance to release the gripping elements 155, as shown in FIG. 10B. To return to the extended position, fluid is supplied through the extension fluid path 365 and the retraction fluid path 366 is opened. It is contemplated that one or more piston and cylinder assemblies may be positioned around the mandrel. It is also contemplated that the cylinder may be an annular cylinder around the mandrel. It is further contemplated the cylinder is attached to the anchor and the piston is attached to the engagement plate.

FIGS. 11A-11D illustrate another embodiment of a wedge release mechanism usable with an external gripping tool 200. The external gripping tool 200 includes the mandrel 110 coupled to a carrier 250. The mandrel 110 has a load collar 252 which can engage an interior shoulder 254 of the carrier 250. The mandrel 110 may have a polygonal cross-section such as a square for transferring torque to the carrier 250. The external gripping tool 200 also includes a plurality of gripping elements 255 and a hydraulic actuator 260 for actuating the gripping elements 255. The hydraulic actuator 260 may be attached to the carrier 250 using a threaded connection. In one embodiment, the gripping elements 255 are slips disposed in the carrier 250. Actuation of the hydraulic actuator 260 causes axial movement of the slips relative to the carrier 250. The gripping elements 255 have wedged shaped back surfaces that engage wedge shaped inner surfaces of the carrier 250. In this respect, axial movement of the gripping elements 255 relative to the wedge surfaces of the carrier 250 causes radial movement of the gripping elements.

A thread compensator 220 may be used to couple the carrier 250 to the mandrel 110. In FIG. 11D, the thread compensator is a spring thread compensator 220 that allows the carrier 250 and its attachments to float independent of the mandrel 110. In one embodiment, the compensator 220 includes a nut 221 threadedly attached to the exterior of the mandrel 110 and a base plate 222 attached to the mandrel 110. In this respect, the nut 221 and the base plate 222 are fixed relative to the mandrel 110. A cover 223 is provided above the base plate 222 and around the nut 221 to support a plurality of pins 224 that extend through apertures in the base plate 222. Compression springs 225 are disposed around each pin 224 and between the upper portion of the cover 223 and the base plate 222. In this respect, the springs 225 may exert a biasing force between the cover 223 and the base plate 222. Because the base plate 222 is fixed to the mandrel 110, the cover 223 is free to move up and down relative to the base plate 222 as dictated by the springs 225. The movement of the cover 223 is also referred to herein as floating relative to the base plate 222 or mandrel 110. The end of the pins 224 protruding from the base plate 222 is connected to the carrier 250. The pins 224 may be connected to the carrier 250 using a threaded connection. The pins 224 allow the carrier 250 to move with the cover 223 in accordance with the biasing force applied by the springs 225. It should be noted that the springs may be replaced with hydraulic pistons.

Figure 11A:
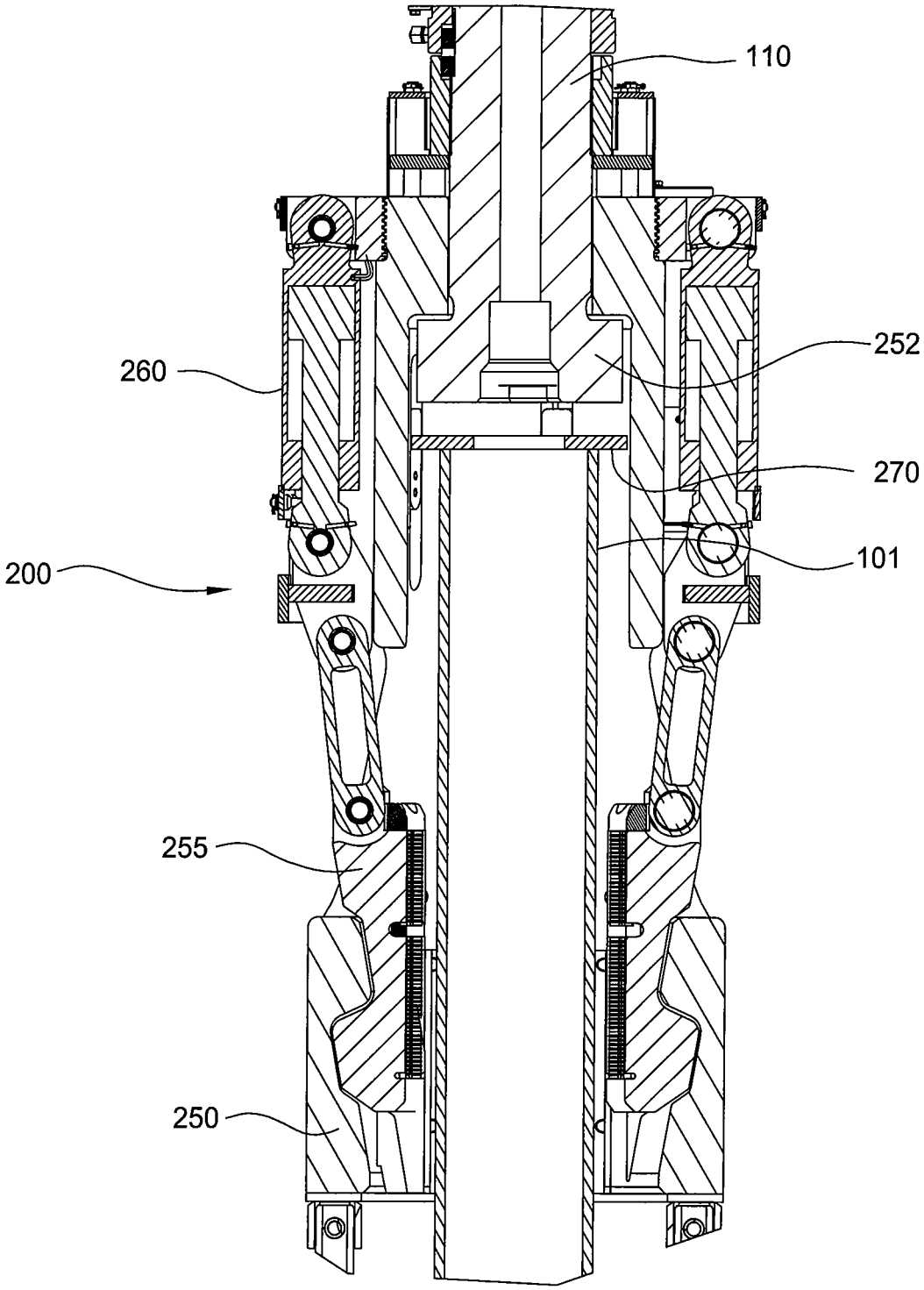
FIGS. 11A-11D illustrate another embodiment of a wedge release mechanism usable with an external gripping tool.
Figure 11B:
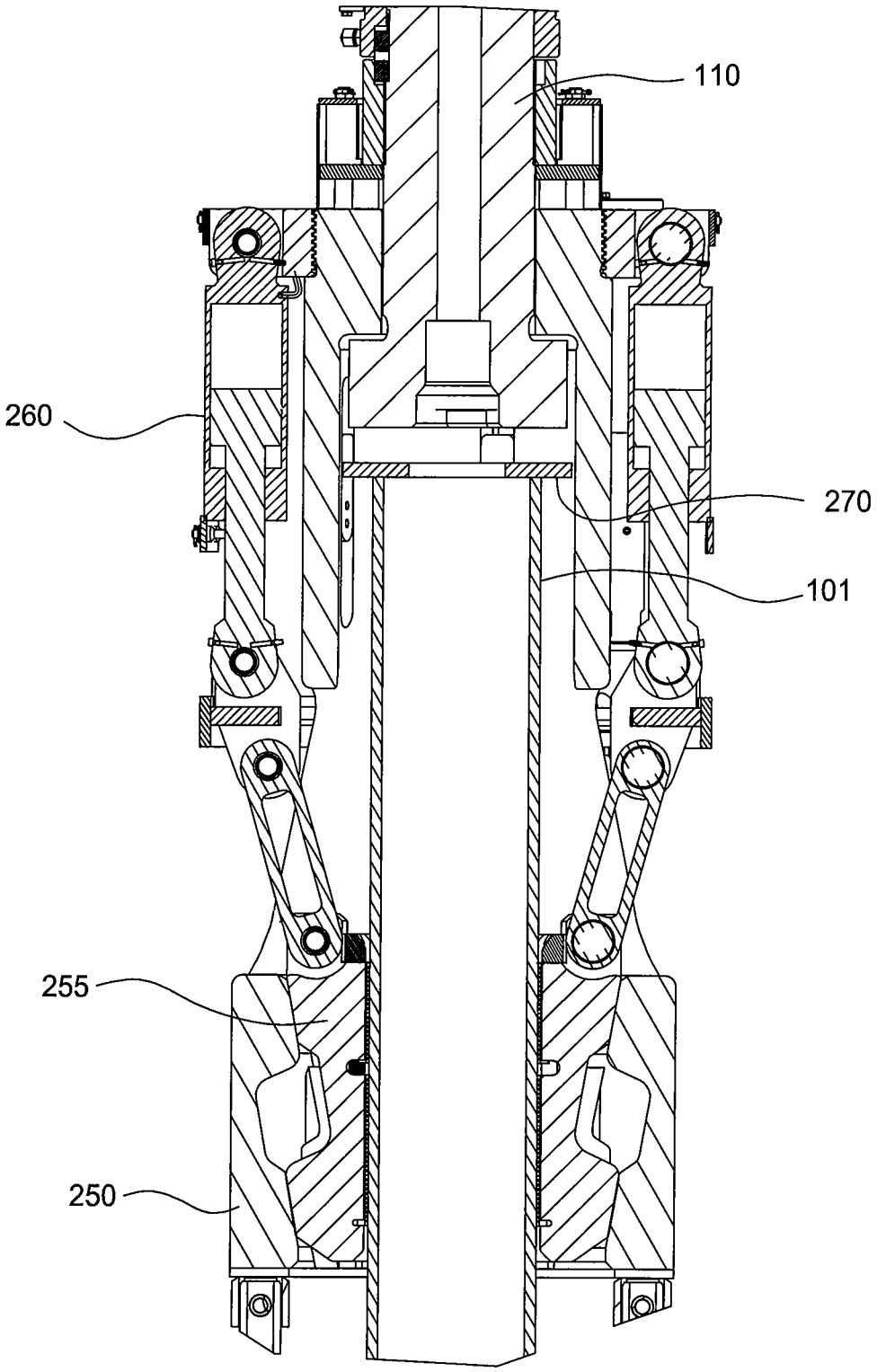
Figure 11C:
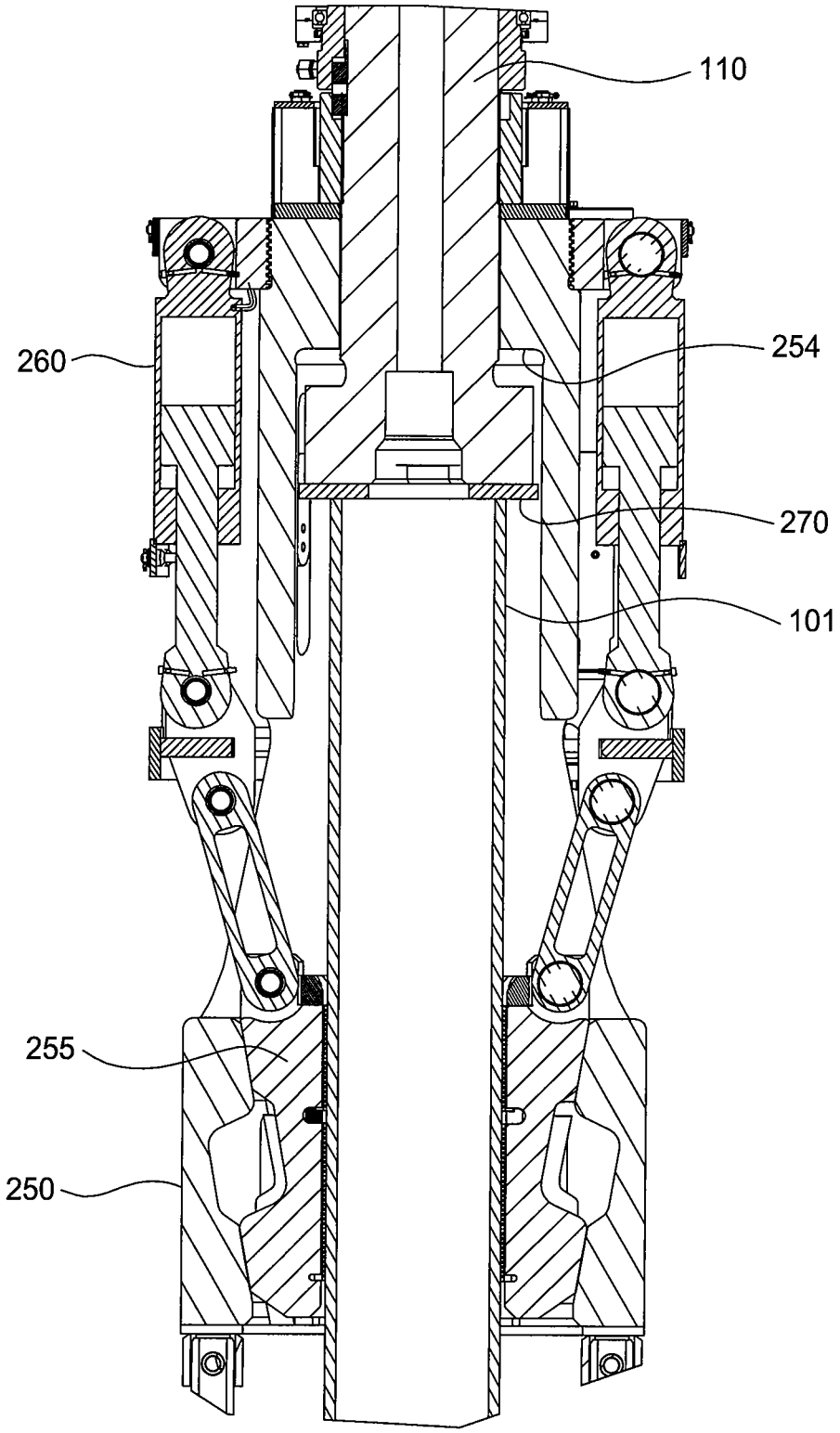
Figure 11D:
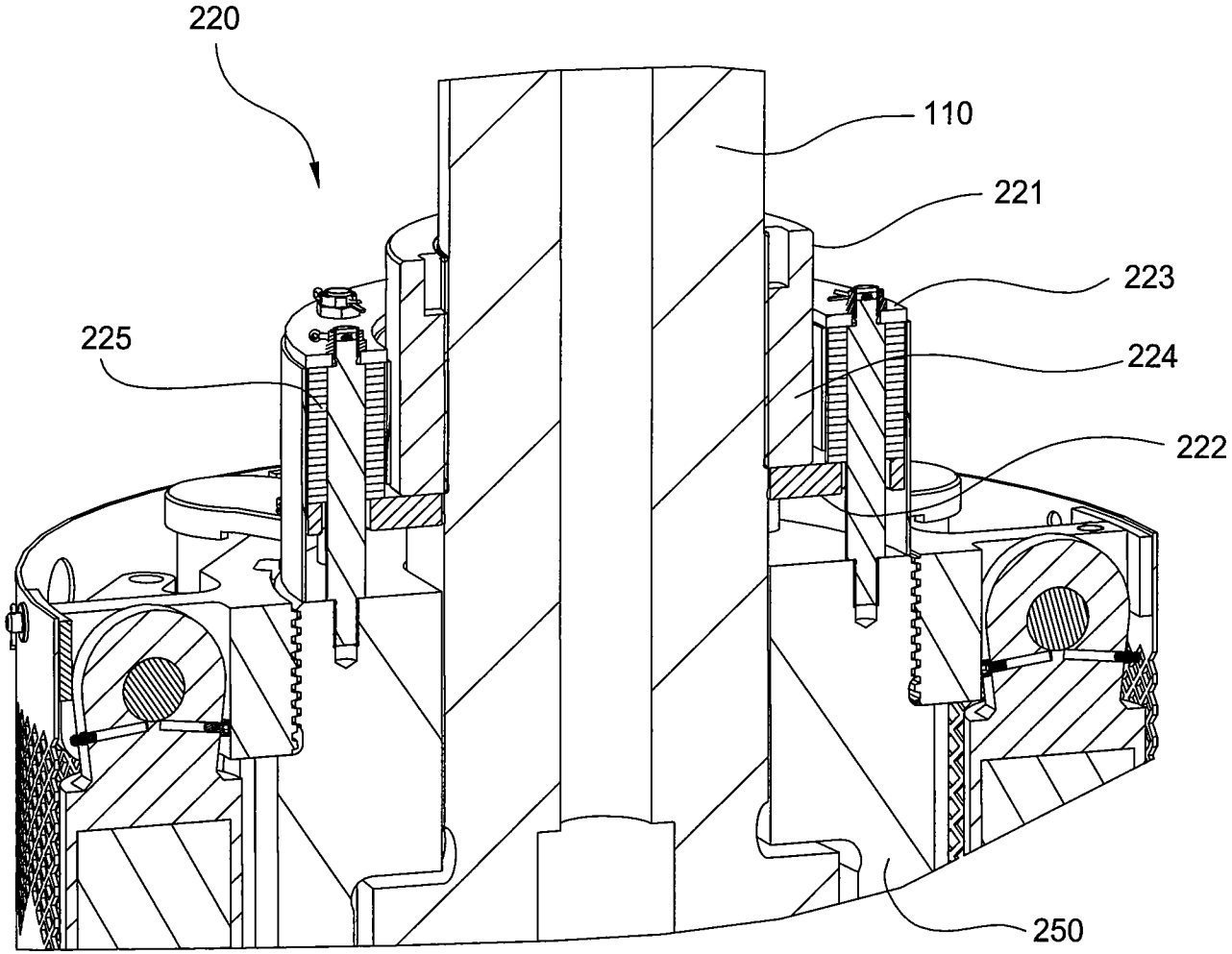

Referring to FIG. 11A, the carrier 250 is supported by the load collar 252 of the mandrel 110. The wedge slips 255 are in the retracted position. The tubular is positioned in the carrier 250 such that the coupling 101 is in contact with the engagement plate 270. A gap exists between the load collar 252 and the engagement plate 270. In FIG. 11B, the clamping cylinders 260 are actuated to extend the gripping elements 255 into engagement with the tubular 102. The gripping elements 255 are urged inwardly by the corresponding wedge surfaces of the carrier 250. As shown, the relative position of the engagement plate 270 and the mandrel 110 has not changed. If a pushing force is desired, the mandrel 110 will lower down relative to the carrier 250 and come into contact with the engagement plate 270 to place load directly on the tubular 102. FIG. 11C shows the mandrel 110 in contact with the engagement plate 270. In this position, a gap now exists between the load collar 252 and the shoulder 254 of the carrier 250. The presence of the gap prevents the wedge lock condition from occurring. In one embodiment, the thread compensator 220 will lift the carrier 250 up from the mandrel 110, thereby creating a clearance between the mandrel 110 and the carrier 250. The clearance provides the spacing required for the release of the gripping elements 255.

For operations involving applying a pushing force, the external gripping tool 200 should be lowered over the tubular 102 until a coupling indicator indicates that the coupling 101 has been reached. Then, the gripping elements 255 may be applied to grip the tubular 102. The connection is then made up. Thereafter, the external gripping tool 200 is lowered until the mandrel 110 reaches the coupling, and the push force may now be applied.

Figure 12:
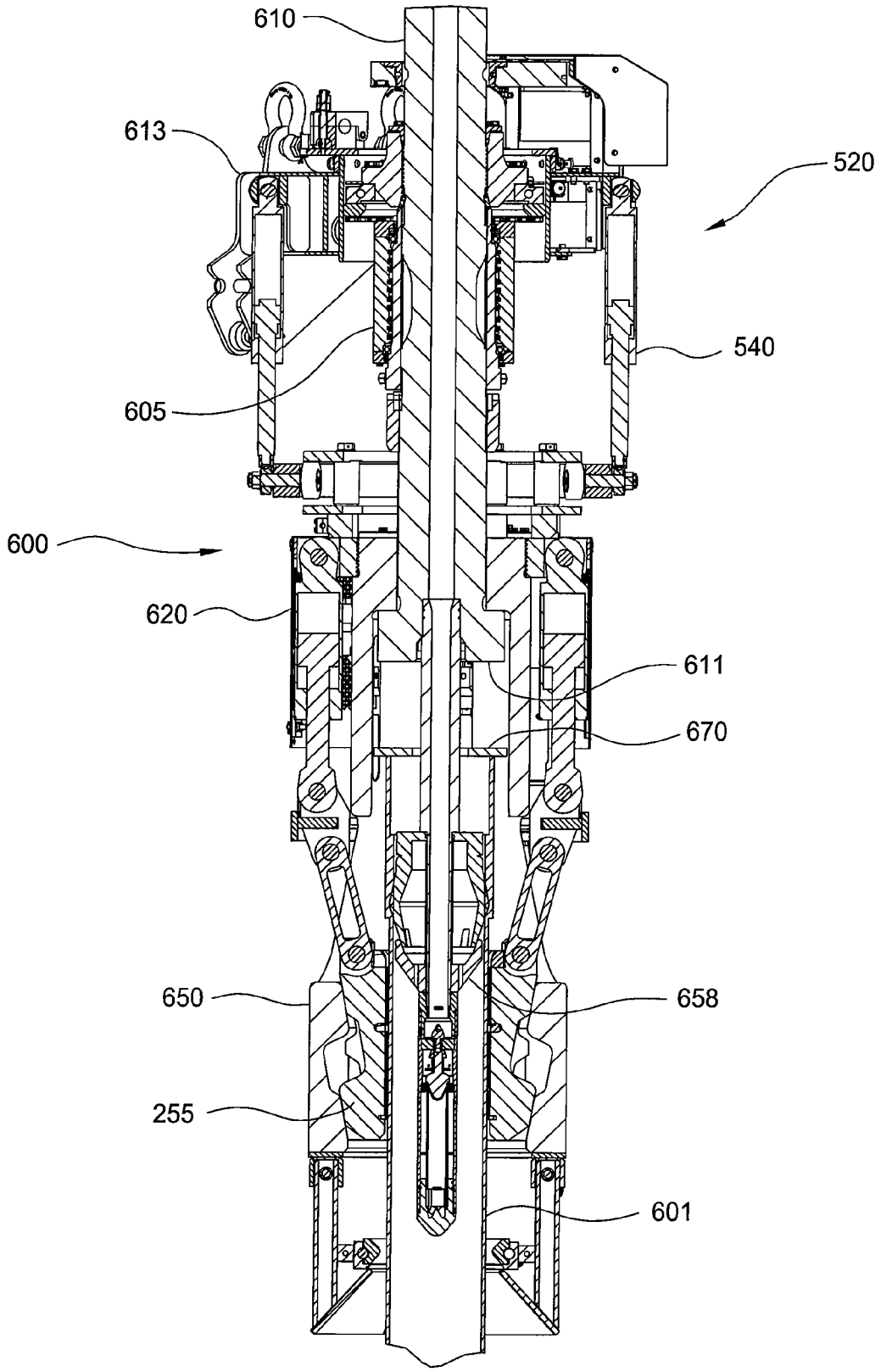
FIG. 12 shows another embodiment of a tubular handling apparatus.

FIG. 12 shows an exemplary tubular handling apparatus 600 having a mandrel 610 coupled to a carrier 650. A swivel 605 is disposed above the mandrel 610. A link support housing 613 of a link assembly 108 is attached to the mandrel 610 above the swivel 605, and a thread compensator 520 is attached to the link support housing 613. In one embodiment, the tubular handling apparatus may be equipped with a torque measuring device. The torque measuring device includes a torque shaft rotationally coupled to the top drive, a strain gage disposed on the torque shaft for measuring a torque exerted on the torque shaft by the top drive, and an antenna in communication with the strain gage. As shown, the tubular handling apparatus 600 has gripped the tubular 601 using gripping elements 255 such as slips. The slips are actuated by a hydraulic actuator 620 that moves the slips axially relative to the carrier 650. The tubular 101 is in contact with an engagement plate 670, which is disposed below the load collar 611 of the mandrel 610. A fill-up and circulation tool 658 may be installed on the tubular handling apparatus 600.

Figure 13:
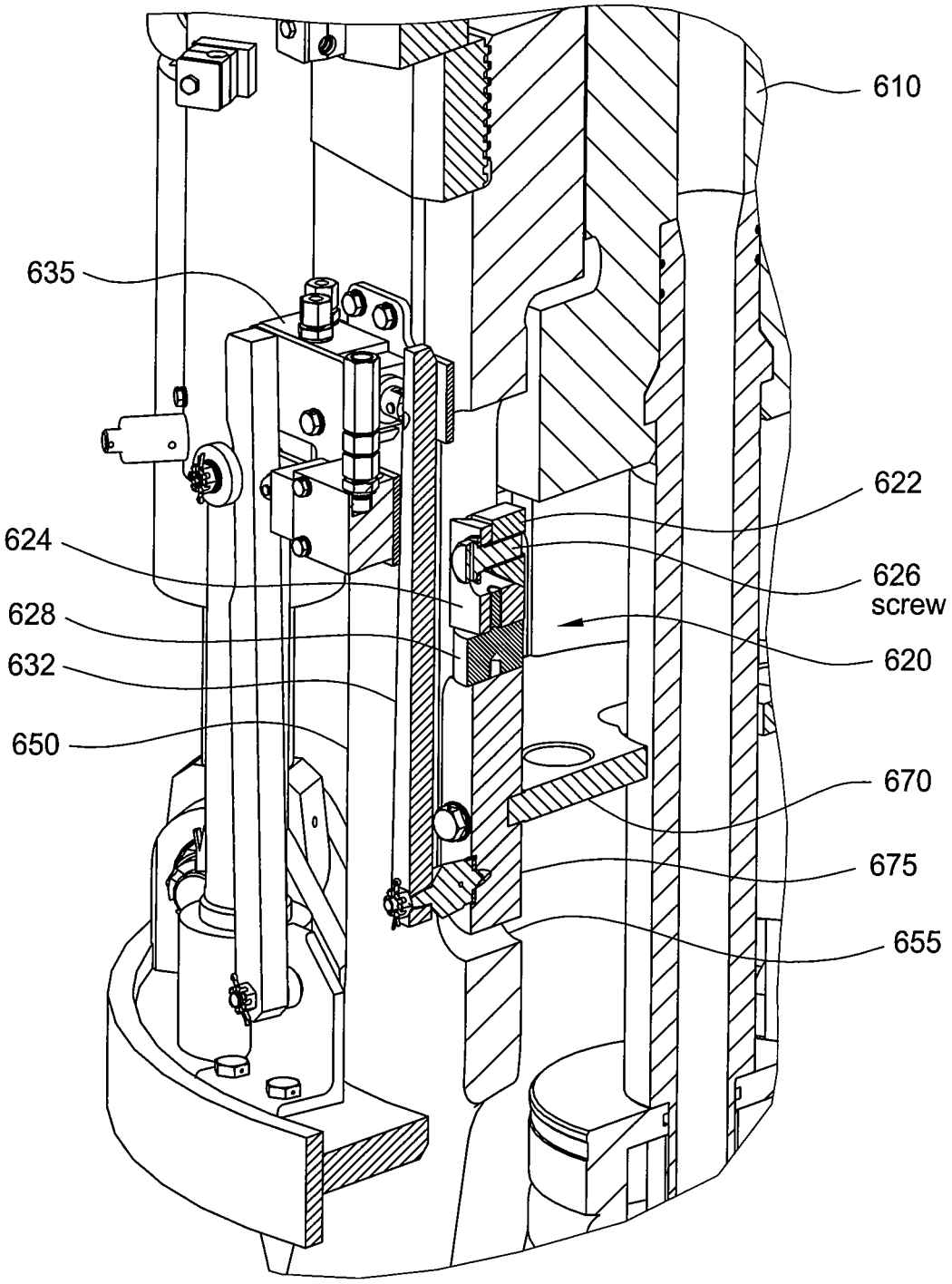
FIG. 13 shows another embodiment of a wedge lock release mechanism installed on the tubular handling apparatus of FIG. 12.

FIG. 13 shows a partial view of another embodiment of a wedge lock release mechanism 620 installed on the tubular handling apparatus. The tubular handling apparatus is shown with the mandrel 610 supporting the carrier 650. The bumper plate 670 is positioned inside the carrier 650 for engagement with the tubular. Engagement with the tubular may cause the bumper plate 670 to move axially relative to the carrier 650. In one embodiment, the bumper plate 670 is coupled to the carrier 650 using guiding elements 675 that are movable in a slot 655 of the carrier 650.

The release mechanism 620 acts as a stop member for limiting the upward movement of the guiding elements 655 and the bumper plate 670. In one embodiment, the release mechanism 620 includes an anchor 622 attached to the carrier 650. The anchor 622 may be attached using welding or other suitable methods of attachment. In another embodiment, the anchor 622 and the carrier 650 may be formed from one piece of steel or other suitable material. An engagement member 624 is coupled to the anchor 622 using a connection device 626 such as a screw. The engagement member 624 has a wedge surface that is movable along a wedge surface of the anchor 622. Movement of the engagement member 624 is controlled by releasing the screw 626. An optional rubber bumper 628 releasably attached to the engagement member 624 may be provided for engagement with the guiding element 675. The rubber bumper 628 may be exchanged as it wears down from use.

Figure 14:
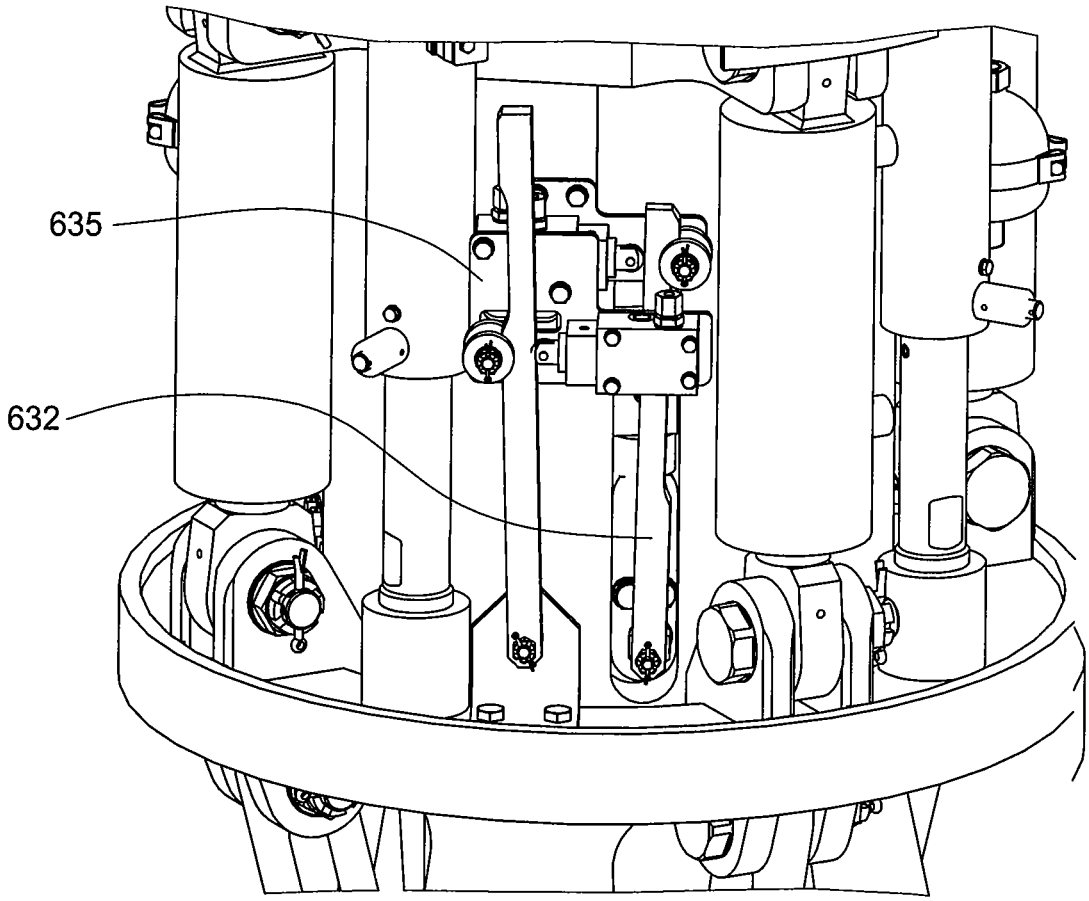
FIG. 14 is a partial perspective view of the tubular handling apparatus of FIG. 12.
Figure 15:
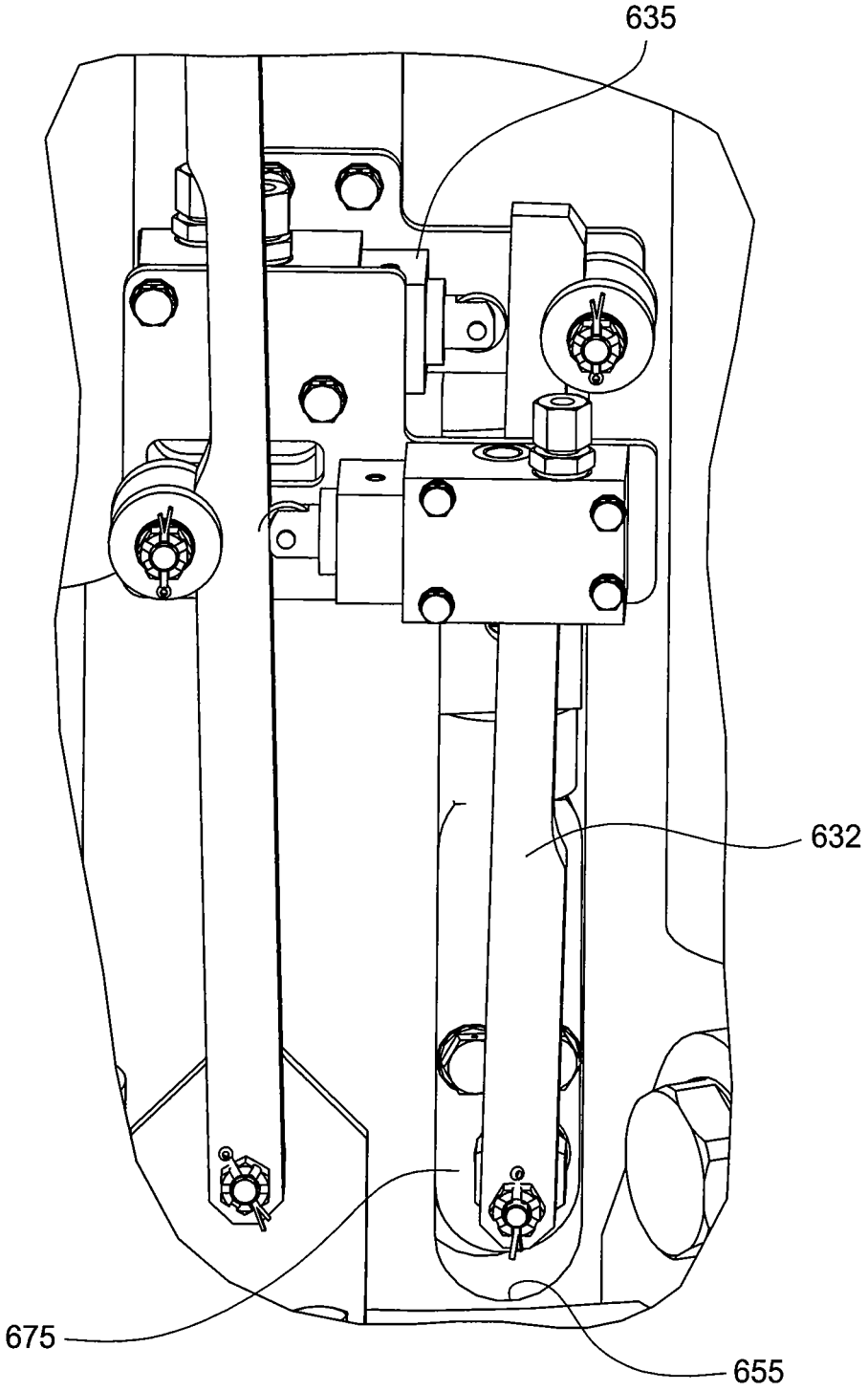
FIG. 15 is a partial exploded view of FIG. 14.

The tubular handling apparatus may optionally include a coupling detection system for indicating presence of a coupling. The coupling detection system includes a coupling indicator 632 connected to the guiding elements. The coupling indicator 632 may be an elongated member having tapered portions to indicate the position of the tubular coupling. A lower end of the coupling indicator 632 is connected to the coupling engagement plate 670 and movable therewith. In one embodiment, the coupling indicator 632 has an upper narrow portion and a lower wide portion to indicate the absence or presence of the coupling. A sensor 635 may be adapted to read the coupling indicator 632 to determine the presence or absence of the coupling in a similar manner as the sensor 175. FIG. 14 shows the position of the indicator 632 when the guiding element is contacting the rubber bumper 628. FIG. 15 is a partial exploded view of FIG. 14.

Figure 16:
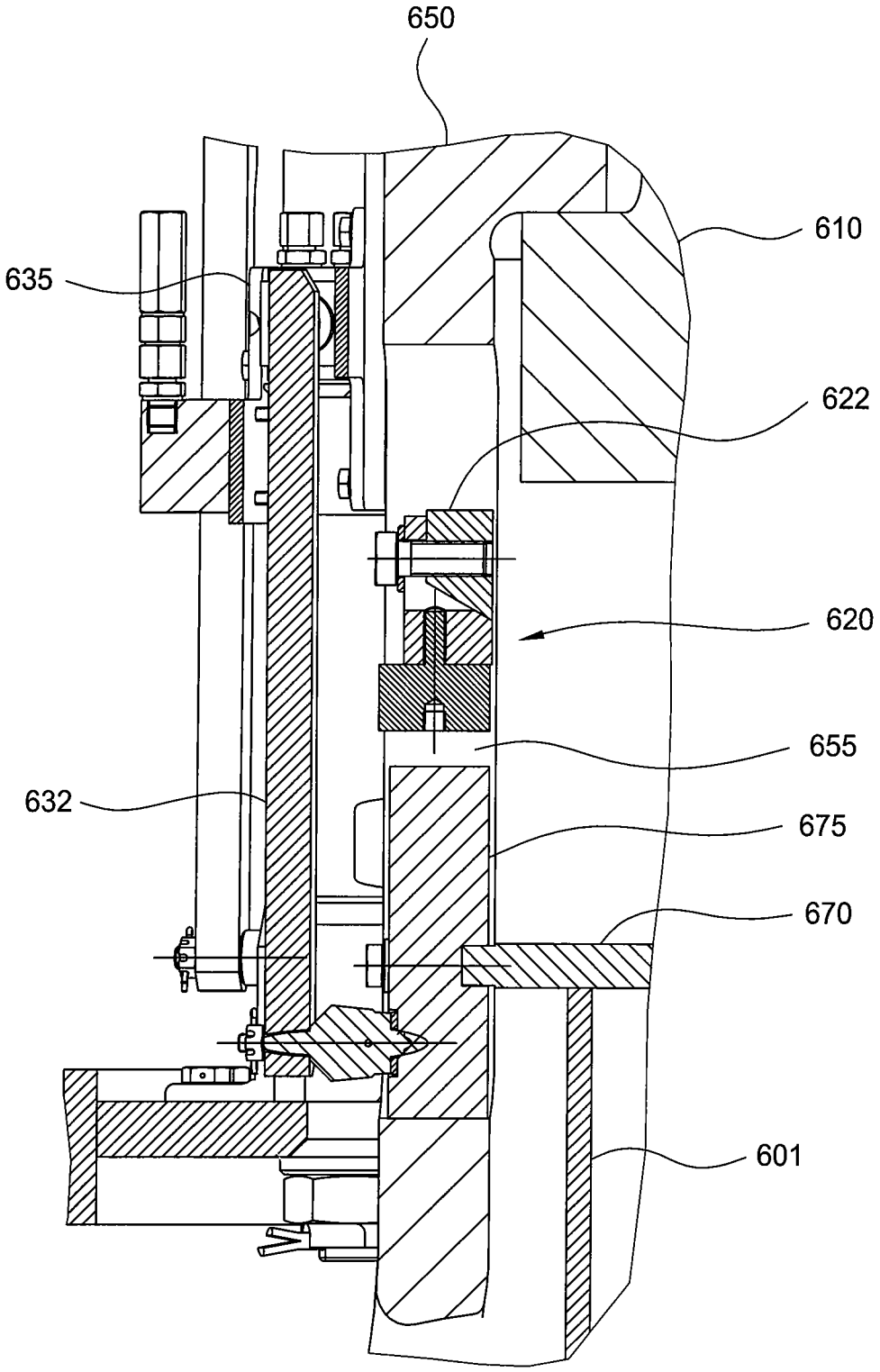
FIGS. 16-19 are partial exploded views of the tubular handling apparatus in operation.

FIGS. 16-19 are partial exploded views of the tubular handling apparatus in operation. In FIG. 16, the tubular handling apparatus has been lowered until the bumper plate 670 engages the casing 601. In one embodiment, the tubular handling apparatus is lowered with the thread compensator 520 activated. In this respect, a substantial portion of the weight of the carrier is borne by the thread compensator 520, while the remainder is borne by the shoulder of the mandrel 610. The thread compensator 520 may hold at least 85% of the weight; preferably, at least 95%. As shown, the bumper plate 670 is at the lower end of the slot 655 and has not engaged the release mechanism 620. In this position, further lowering of the apparatus will lower the carrier 650 relative to the bumper plate 670, which is resting on top of the casing 601.

Figure 17:
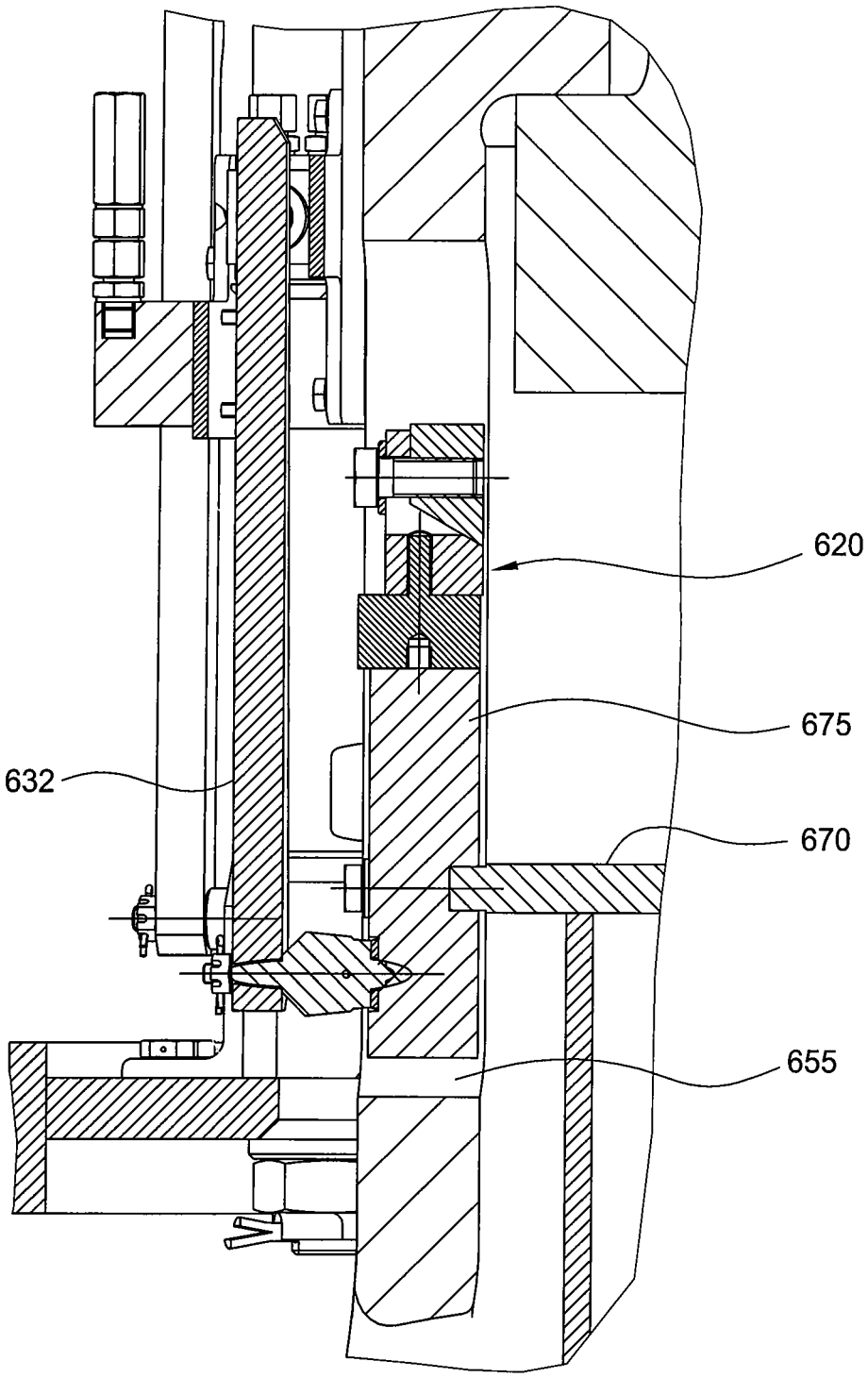

FIG. 17 shows the tubular handling apparatus being lowered further. The carrier 650 has moved relative to the bumper plate 670, thereby causing the guiding elements 675 to engage rubber bumper 628 of the release mechanism 620. In this position, further lowering of the apparatus will lower the mandrel 610 relative to the carrier 650. Also, a substantial portion of the weight of the carrier continues to be borne by the thread compensator 520, while the remainder is now borne by the bumper plate 670. The thread compensator 520 may hold at least 85% of the weight; preferably, at least 95%. In addition, the coupling indicator 632 has moved up with the bumper plate 670, which movement is detected by the sensor 635.

Figure 18:
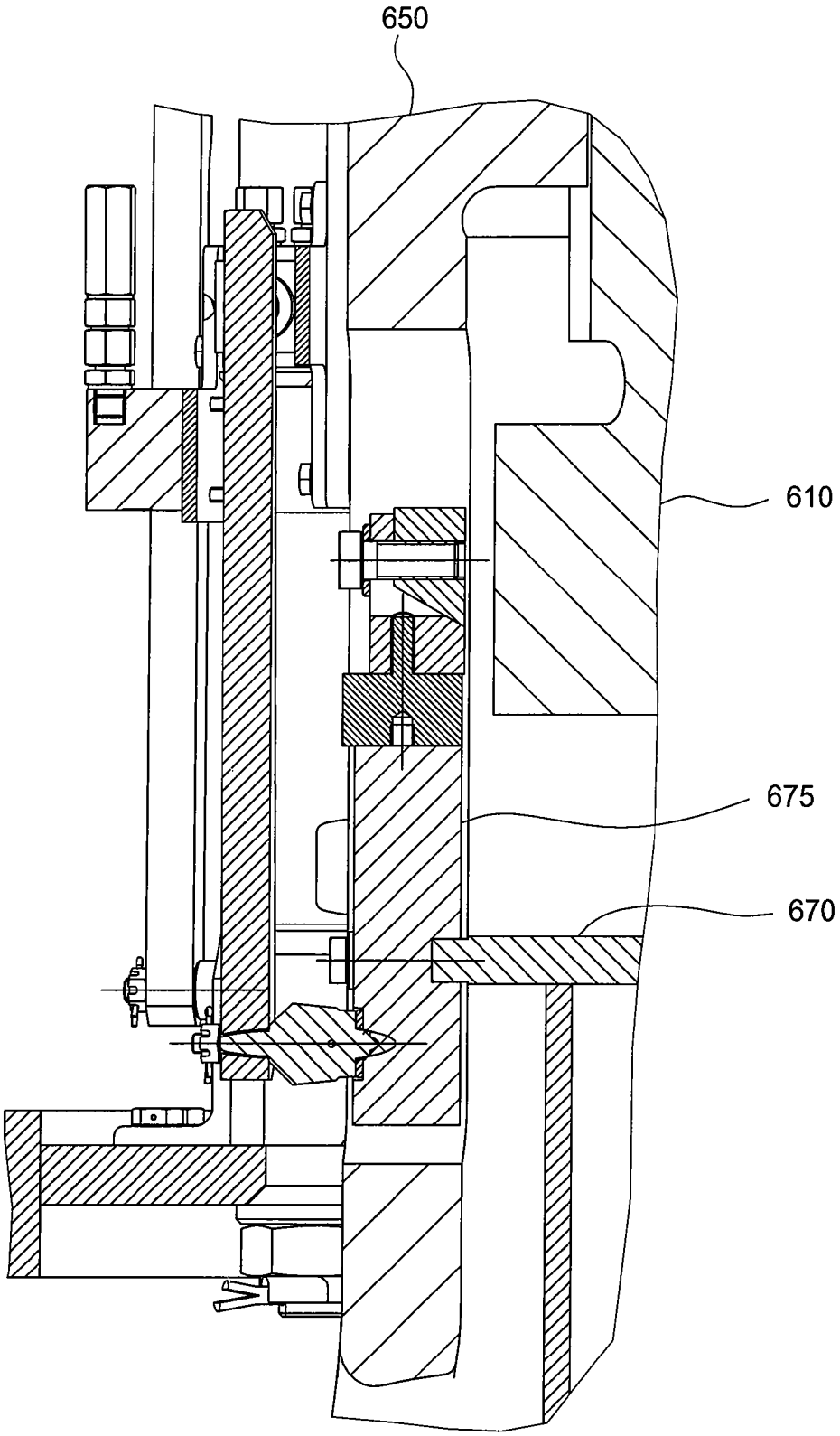

FIG. 18 shows the mandrel 610 relative to the carrier 650 after the lowering of the tubular handling apparatus has stopped and in anticipation of the thread compensation. As shown, the mandrel 610 is not in contact with the bumper plate 670. The distance between the load shoulder of the mandrel 610 and the shoulder of the carrier 650 may be used for thread compensation. In one embodiment, a sensor may be provided to measure the optimal distance (i.e., the minimal distance required for thread compensation) has been reached. In another embodiment, a sensor may be provided to warn the distance is insufficient to avoid contact of the mandrel 610 with the bumper plate 670.

Figure 19:
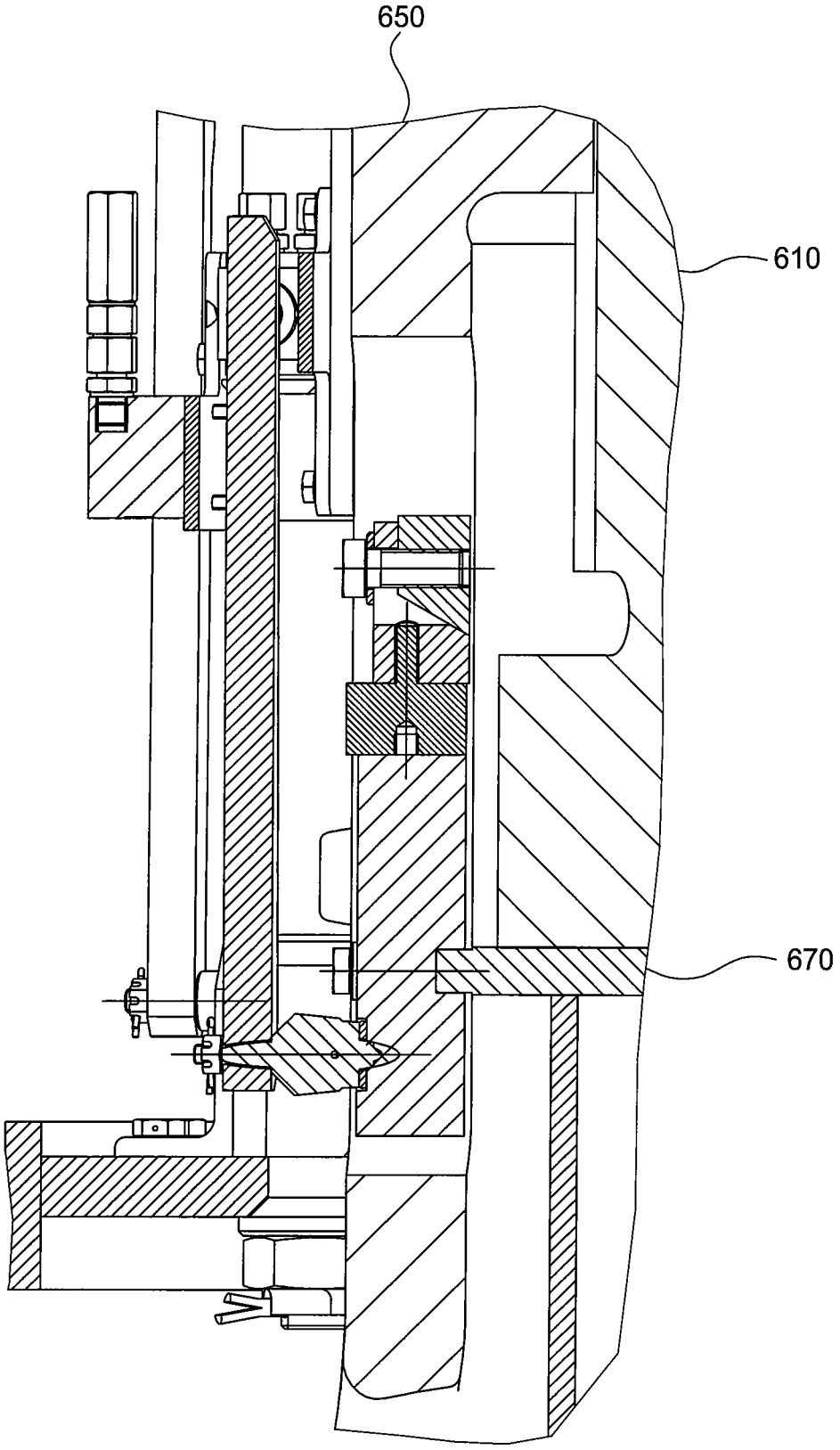

FIG. 19 shows the situation where the mandrel 610 is contacting the bumper plate 670. This may occur after the casing has been made up and when a push force is applied to the casing string using the tubular handling apparatus. This position allows axial force to be applied to the casing string without loading the gripping elements.

Figure 20:
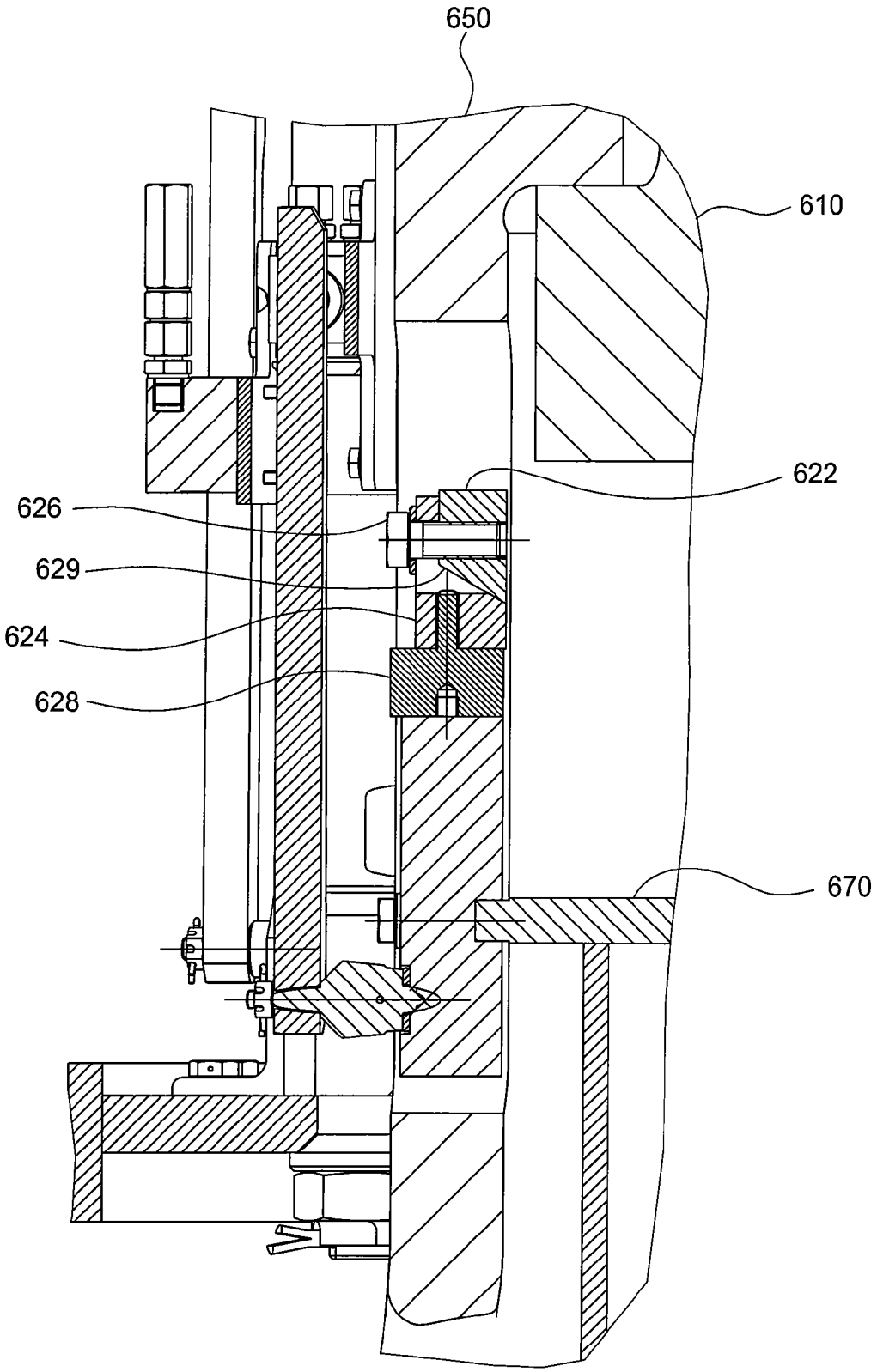
FIG. 20 shows the wedge lock release mechanism of FIG. 13 in the unreleased position.
Figure 21:
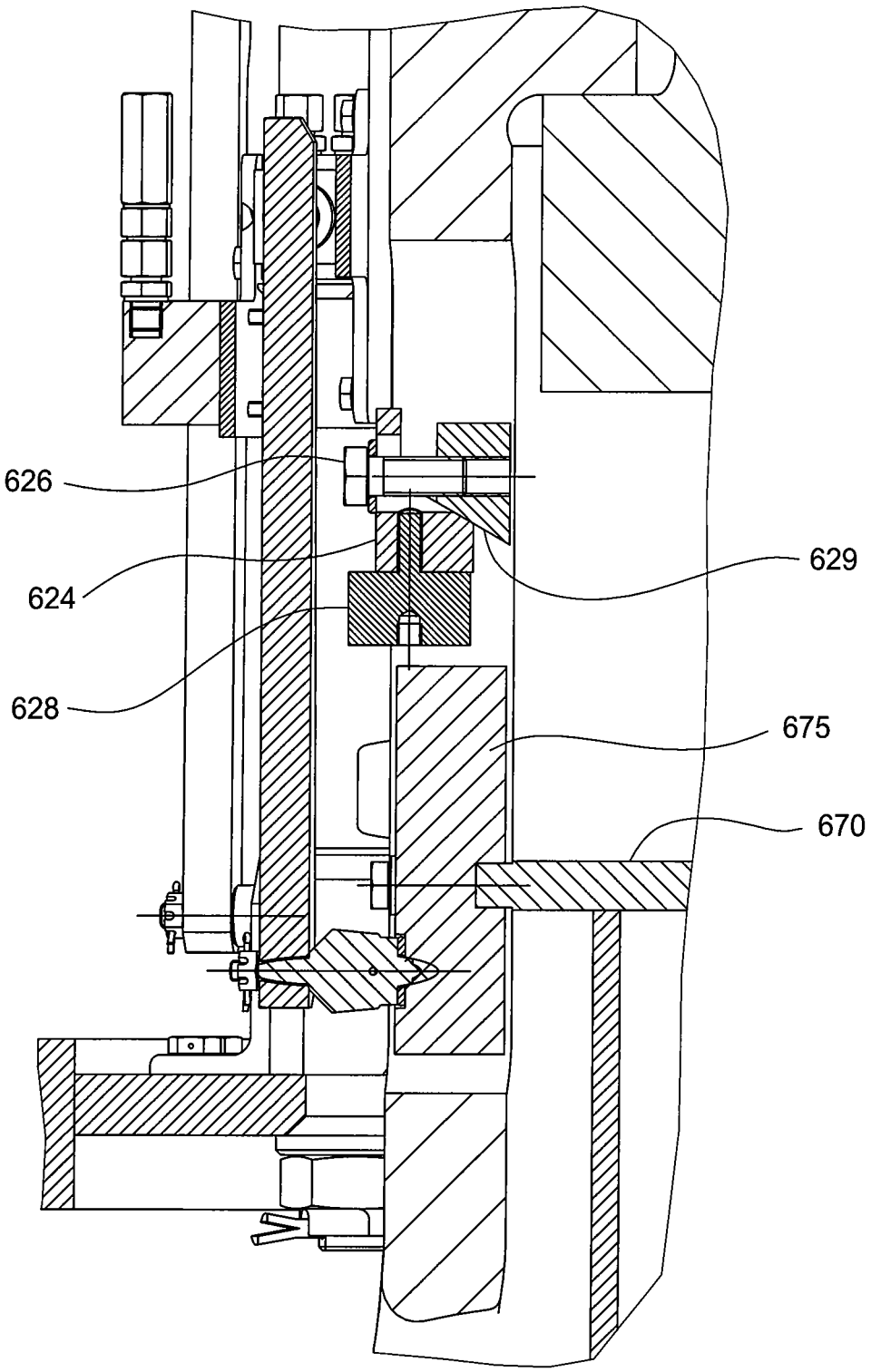
FIG. 21 shows the wedge lock release mechanism of FIG. 13 in the released position.

When the situation shown in FIG. 19 occurs, the carrier 650 cannot move upward to release the gripping elements. This situation may be referred as a "wedge lock" condition. To remedy this situation, the screw 626 may be released from the anchor 622. FIG. 20 shows the screw 626 in the unreleased position. FIG. 21 shows the screw 626 in the released position. As the screw 626 is released from the anchor 622, the engagement member 624 is moved along the wedge surface and away from the guiding elements 675, thereby creating a space 660 between the rubber bumper 628 and guiding elements 675. The space 660 allows the carrier 650 to move axially relative to the gripping elements, thereby releasing the gripping elements from the casing.

Actuation of each mechanism described herein may be manual, hydraulic, pneumatic or electric. Actuation may further be initiated locally at the tool or remotely from a control panel. Furthermore, actuation may be triggered automatically by a control command to release the slips. In all embodiments, the devices may be reset to their original positions after the slips have been released from the tubular.

In all embodiments, the devices may be reset to their original positions after the slips have been released from the tubular. Resetting may be manual, hydraulic, pneumatic or electric. Resetting may further be initiated locally at the tool or remotely from a control panel. Furthermore, Resetting may be triggered automatically by a control command, for example to engage the slips. In all embodiments, the devices may be reset to their original positions after the slips have been released from the tubular.

In addition to casing, aspects of the present invention are equally suited to handle tubulars such as drill pipe, tubing, and other types of tubulars known to a person of ordinary skill in the art. Moreover, the tubular handling operations contemplated herein may include connection and disconnection of tubulars as well as running in or pulling out tubulars from the well.

In another embodiment, a release apparatus for releasing a gripping element of a tubular handling apparatus includes an anchor attached to the tubular handling apparatus and an engagement member for engaging the tubular, wherein the position of the engagement member relative to the anchor is selectively adjustable to allow for relative axial movement between the anchor and the tubular. In yet another embodiment, the release apparatus is configured to be manually actuated or remotely actuated. In yet another embodiment, the release apparatus is configured to be hydraulically actuated, pneumatically actuated, electrically actuated, and combinations thereof. In yet another embodiment, the release apparatus is configured to be resettable.

In one embodiment, a release apparatus for releasing a gripping element of a tubular handling apparatus includes an anchor attached to the tubular handling apparatus; an engagement member for engaging the tubular; and an abutment device disposed between the anchor and the engagement member, wherein a length of the abutment device is adjustable relative to the anchor.

In another embodiment, a tubular handling apparatus for handling a tubular includes a mandrel; a carrier coupled to the mandrel; a gripping element for engaging the tubular; an engagement member coupled to the carrier for engaging an upper portion of the tubular; and an abutment device adapted to engage the engagement member, wherein a length of the abutment device is adjustable to allow movement of the engagement member. Further, the length of the abutment device may be adjusted manually or by remote actuation.

While the foregoing is directed to embodiments of the present invention, other and further embodiments of the invention may be devised without departing from the basic scope thereof, and the scope thereof is determined by the claims that follow.

We claim:

1. A release apparatus for releasing a gripping element of a tubular handling apparatus, comprising:

an engagement member for engaging a top end surface of a tubular;

an anchor attached to the tubular handling apparatus;

an abutment device for limiting movement of the engagement member, wherein the abutment device is selectively movable along an inclined surface of the anchor; and a connection device coupling the abutment device to the anchor, wherein the connection device is adjustable to move the abutment device relative to the anchor.

2. The apparatus of claim 1, wherein the abutment device is disposed between the anchor and the engagement member.

3. The apparatus of claim 1, wherein the connection device comprises a screw.

4. The apparatus of claim 1, further comprising a bumper attached to the abutment device.

5. The release apparatus of claim 1, wherein the release apparatus is configured to be manually actuated or remotely actuated.

6. The release apparatus of claim 1, wherein the release apparatus is configured to be resettable.

7. The apparatus of claim 1, wherein the engagement member comprises a plate.

8. The apparatus of claim 1, wherein the engagement member is positioned transversely relative to a longitudinal axis of the tubular handling apparatus.

9. The apparatus of claim 8, wherein the engagement member comprises a plate.

10. The release apparatus of claim 1, wherein the engagement member prevents upward movement of the tubular but allows downward movement of the tubular when engaged with the upper end of the tubular.

11. A tubular handling apparatus for handling a tubular, comprising:

a mandrel;

a gripping element for gripping the tubular;

an actuator coupled to the mandrel and axially movable relative to the mandrel for engaging or disengaging the gripping element from the tubular;

an engagement member for engaging a top end surface of the tubular; and an abutment device adapted to limit axial travel of the engagement member, wherein movement of the abutment device is independent from movement of the mandrel.

12. The apparatus of claim 11, further comprising an anchor attached to the actuator.

13. The apparatus of claim 12, wherein the abutment device is movable relative to the anchor.

14. The apparatus of claim 13, wherein the abutment device moves along an incline of the anchor.

15. A method of releasing from a wedge lock condition during a tubular handling operation, comprising:

providing a tubular handling apparatus having a mandrel, a gripping element movable along the mandrel, and an engagement member for contacting a tubular;

attaching a release mechanism to the mandrel, wherein the release mechanism includes an anchor, an abutment device axially movable relative to the anchor, and a connection device coupling the abutment device to the anchor;

engaging the tubular to the engagement member and the engagement member to the abutment device;

adjusting the connection device to move the abutment device away from the engagement member;

moving the mandrel relative to the engagement member; and releasing the gripping element.

16. The method of claim 15, wherein adjusting the connection device comprises rotating the connection device.

17. The method of claim 15, wherein the abutment device moves along an incline of the anchor.

18. The method of claim 15, further comprising coupling an indicator to the engagement member.

19. The method of claim 15, linking operation of the release mechanism to the operation of a clamping cylinder.

20. A release apparatus for releasing a gripping element of a tubular handling apparatus, comprising:

an engagement member for engaging a top end surface of a tubular;

an anchor attached to the tubular handling apparatus;

an abutment device for limiting movement of the engagement member, wherein the abutment device is disposed between the anchor and the engagement member; and a connection device coupling the abutment device to the anchor, wherein the connection device is adjustable to move the abutment device relative to the anchor.

* * * * *